US008011994B2

(12) United States Patent
Fink et al.

(10) Patent No.: US 8,011,994 B2
(45) Date of Patent: Sep. 6, 2011

(54) SELF-ASSEMBLING TOY, TOY ASSEMBLER, LAUNCHER, AND TRACK

(75) Inventors: Steven Fink, Cincinnati, OH (US); Neil Hamilton, Covington, KY (US); Michael Hoeting, Cincinnati, OH (US); Yannick Poirier, Valleyfield (CA)

(73) Assignee: MEGA Brands International, Luxembourg, Zug Branch (CH)

( * ) Notice: Subject to any disclaimer, the term of this patent is extended or adjusted under 35 U.S.C. 154(b) by 95 days.

(21) Appl. No.: 12/270,027

(22) Filed: Nov. 13, 2008

(65) Prior Publication Data

US 2009/0130946 A1 May 21, 2009

Related U.S. Application Data

(60) Provisional application No. 60/987,531, filed on Nov. 13, 2007, provisional application No. 61/029,245, filed on Feb. 15, 2008.

(51) Int. Cl.
*A63H 17/267* (2006.01)
*A63H 18/00* (2006.01)

(52) U.S. Cl. ..... 446/429; 446/168

(58) Field of Classification Search ..... 446/93, 446/95, 168, 409, 249, 237, 429, 430, 440, 446/246, 435, 423
See application file for complete search history.

(56) References Cited

U.S. PATENT DOCUMENTS

| | | | | |
|---|---|---|---|---|
| 2,970,388 | A | 2/1961 | Yonkers | |
| 3,735,525 | A * | 5/1973 | Freed | 446/435 |
| 3,782,032 | A * | 1/1974 | Glass et al. | 446/429 |
| 4,087,935 | A * | 5/1978 | Edmisson et al. | 446/423 |
| 4,108,437 | A | 8/1978 | DeAnda et al. | |
| 4,464,860 | A * | 8/1984 | Onodera | 446/491 |
| 4,513,967 | A | 4/1985 | Halford et al. | |
| 4,605,230 | A | 8/1986 | Halford et al. | |
| 5,184,970 | A | 2/1993 | Binkley | |
| 5,234,216 | A | 8/1993 | Ostendorff | |
| 6,071,173 | A | 6/2000 | Kelley | |
| 6,435,929 | B1 | 8/2002 | Halford | |
| 6,482,070 | B2 | 11/2002 | Hogan | |
| 6,566,992 | B1 | 5/2003 | Vicentelli | |
| 7,038,567 | B2 | 5/2006 | Vicentelli | |
| 2005/0191938 | A1 | 9/2005 | Sheltman et al. | |
| 2005/0287918 | A1 | 12/2005 | Sheltman et al. | |
| 2006/0014467 | A1 | 1/2006 | Tusacciu | |
| 2007/0293123 | A1 | 12/2007 | Nuttall et al. | |
| 2008/0051001 | A1 | 2/2008 | Nuttall et al. | |

OTHER PUBLICATIONS

MEGA Brands Magnetix MagnaWheels Assembly Instructions, 2007.

* cited by examiner

*Primary Examiner* — Nini Legesse
(74) *Attorney, Agent, or Firm* — Plumsea Law Group, LLC

(57) ABSTRACT

An aspect of the present invention provides a toy assembly system comprising a central compartment configured to house a plurality of toy bodies, each toy body having magnetic hubs arranged in an outer region of the body. The system can include outer compartments that house ferromagnetic outer components (e.g., ferromagnetic spheres) separate from the toy bodies and a release mechanism configured to release during a single operation a single toy body and a set of outer components, wherein the single toy body and the set of outer components self-assemble and automatically align. Another aspect provides a toy track system comprising a launch portion configured to magnetically retain the magnetic vehicle in a launch position, a release configured to release the vehicle from the launch position, and a track portion coupled to the launch portion and configured to guide the released vehicle along a predetermined path.

24 Claims, 25 Drawing Sheets

SELF-ASSEMBLING TOY, TOY ASSEMBLER, LAUNCHER, AND TRACK

This application claims the benefit of U.S. Provisional Application No. 60/987,531, filed Nov. 13, 2007, and U.S. Provisional Application No. 61/029,245, filed Feb. 15, 2008, both of which are herein incorporated by reference in their entirety.

BACKGROUND

1. Field of the Invention

The present invention relates generally to movable toys, and more particularly to assembly and propulsion of toy vehicles.

2. Background of the Invention

Toys that include magnetic components can take advantage of the magnetic properties of the magnetic components. For example, known construction toys employ magnetic rods and/or spheres that can be permanent magnets or ferromagnetic elements for use in building toy structures.

Magnetic marbles can be used in toy vehicles to allow the vehicles to be propelled. For example, U.S. Pat. No. 5,184,970 discloses vehicles comprising pairs of magnetic marbles and a flat sheet of plastic. Each marble of a pair is placed on opposite sides of the flat sheet, positioned at a hole in the sheet that allows the magnetic marbles to directly contact each other. The pairs of marbles rotate when the sheet is propelled.

BRIEF SUMMARY OF THE INVENTION

In one aspect of the present invention, a toy assembly system comprises a central compartment configured to house one or more toy bodies in a predetermined orientation. Each toy body has a plurality of magnetic hubs that are each arranged in an outer region of the toy body (e.g., proximate to the four corners of a toy body shaped as a car chassis). The toy assembly system further includes a set of outer compartments that are each configured to house one or more ferromagnetic outer components separate from the one or more toy bodies. The toy components, such as the toy body and outer components, are held in a predetermined position with respect to one another that enables self-assembly upon release. The toy assembly system also includes a release mechanism configured to release during a single operation a single toy body and a set of outer components, wherein the single toy body and the set of outer components are arranged to self-assemble the toy into precise alignment so that the outer components are aligned along axes defined by the magnetic hubs of the toy body. The self assembly occurs such that the set of outer components are attached to the single toy body when in an assembly position of the toy assembly system.

Preferably, the set of outer components comprises either a set of spheres or a set of cylinders. In one embodiment of the present invention, the toy body comprises a vehicle, wherein the outer compartments comprise a set of chambers designed to house wheels for each wheel position of the vehicle. The wheels can be, for example, ferromagnetic spheres. The magnetic hubs of the toy body can comprise rotatable cylindrical bodies that each include a magnet and that each include an outer surface substantially perpendicular to the rotation axis of the rotatable cylindrical body, and configured to attach to a ferromagnetic sphere. The outer surface preferably includes a recess, wherein the recess is configured to accommodate a portion of a ferromagnetic sphere.

Preferably, the rotatable cylindrical bodies are each disposed on a rotatable shaft whose longitudinal axis is perpendicular to a direction of travel of the toy body.

The release mechanism preferably comprises one or more of a retractable holder that releases the set of outer components into an assembly position; a retractable holder that releases the toy body into an assembly position; and a retractable barrier between the toy body and the set of outer components.

In one embodiment of the present invention, the toy assembly system can further comprise an ejector that is configured to propel an assembled toy in a forward motion from the toy assembly system, wherein the ejector includes a set of adjustable or retractable barriers configured to permit the forward motion of the assembled toy when the ejector is engaged.

Preferably, the central compartment and outer compartments are contained in a common housing. In one embodiment of the present invention, at least portions of the central and outer compartments are transparent, such that, at a given time, at least one toy body and a set of outer components are substantially visible to an operator of the toy assembly system.

In another embodiment of the present invention, a toy system comprises one or more mobile parts that each includes a magnetic central body. The magnetic central body includes a set of magnetic hubs located in outer regions of the magnetic central body, and a plurality of ferromagnetic outer parts that are each configured to self assemble to the magnetic central body by attaching to one of the magnetic hubs. The toy system additionally includes an assembler that includes a central chamber to house one or more magnetic central bodies and a set of peripheral chambers that are each configured to house one or more ferromagnetic outer parts separate from the one or more magnetic central bodies. The toy system is configured such that in an assembly position, the magnetic central body and the plurality of ferromagnetic outer parts are brought into physical proximity such that a magnetic force extending therebetween is sufficient to cause attachment of the ferromagnetic outer parts to the magnetic central body. The toy system can also include an ejector configured to propel an assembled mobile part from the assembly position.

In one embodiment of the present invention, the toy system further comprises a release member that is mechanically coupled to both the assembler and the ejector, wherein, when moved in a first direction, the release member is configured to release a magnetic central body and a set of outer parts into the assembly position, wherein the central body and outer parts form an assembled toy. Furthermore, when moved in a second direction, different from the first direction, the release member is configured to eject the assembled toy.

In another embodiment of the present invention, a self assembling toy comprises a body and a set of rotatable components each having a central portion that is contained within the body and each including one or more magnetic hubs that extend at least in part outside the body. The self-assembling toy further comprises a set of reversibly attachable ferromagnetic outer components that are each configured to self-attach to a magnetic hub of a respective rotatable component when the respective outer component is separated by no more than a predefined distance from the rotatable component, wherein each outer component is configured in an operable state after self-attachment.

In an additional embodiment of the present invention, a toy assembly and launch system comprises a plurality of toy bodies, each toy body configured with outer regions having magnetic hubs that each comprises a permanent magnet. The system further includes a central compartment configured to house the plurality of toy bodies in a stacked configuration, wherein the plurality of toy bodies are arranged one on top of another. The system also includes a set of outer compartments that are each configured to house one or more ferromagnetic wheels separate from the plurality of toy bodies. The toy assembly and launch system also includes a release mechanism configured to release during a single operation a single toy body and a set of ferromagnetic wheels into an assembly position, wherein the single toy body and the set of ferromagnetic wheels are arranged to self-assemble into an assembled toy. In the assembled toy, each ferromagnetic wheel of the set of ferromagnetic wheels is attached to a respective magnetic hub of the single toy body. The toy assembly and launch system further includes a launching system configured to propel an assembled toy from the assembly position.

In another embodiment of the present invention, a track system for a magnetic vehicle comprises a launch portion configured to magnetically hold the magnetic vehicle at a launching position, and a track portion coupled to the launch portion and configured to magnetically attract the magnetic vehicle as the magnetic vehicle traverses over the track portion.

DETAILED DESCRIPTION OF THE INVENTION

Aspects of the present invention are related to a self-assembling magnetic toy and a toy assembler. In embodiments of the present invention, the toy assembler is configured with a launcher that launches the assembled toy.

Figure 1A:
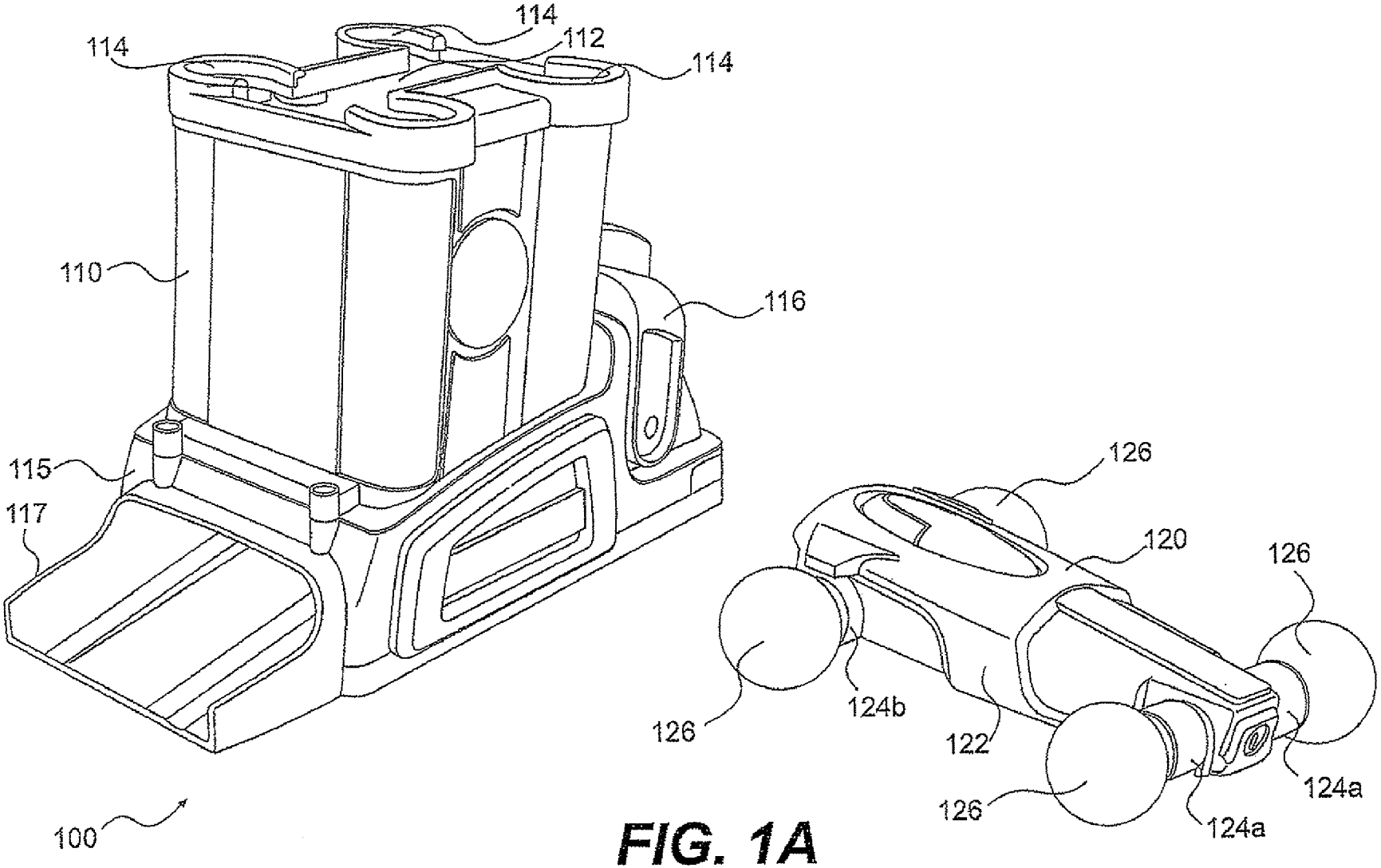
FIG. 1A is a schematic diagram that depicts a perspective view of a toy assembly system and a representative toy, according to one aspect of the present invention.

FIG. 1A depicts in perspective view a system 100 for toy assembly, in accordance with an embodiment of the present invention. System 100 includes an assembler/launcher 110 and a self-assembling toy 120, which, in the embodiment shown, is a four wheeled vehicle (and is also referred to in the discussion to follow as vehicle 120), but can in general be other types of toys that are built using magnetic components.

Vehicle 120 (also termed "magnetic vehicle") comprises a body 122, respective front and rear magnetic hubs 124*a*, 124*b*, and a set of reversibly detachable wheels 126. The term "magnetic hubs," as used herein, refers to regions of the vehicle that contain magnetic material, but need not comprise magnetic material in their entirety. Thus, as described in detail below, magnetic hubs 124*a* and 124*b* can comprise cylindrically shaped regions that include magnetic and non-magnetic materials. The term "magnetic vehicle" as used herein refers to a vehicle that has one or more magnetic portions such as magnetic hubs.

Figure 2B:
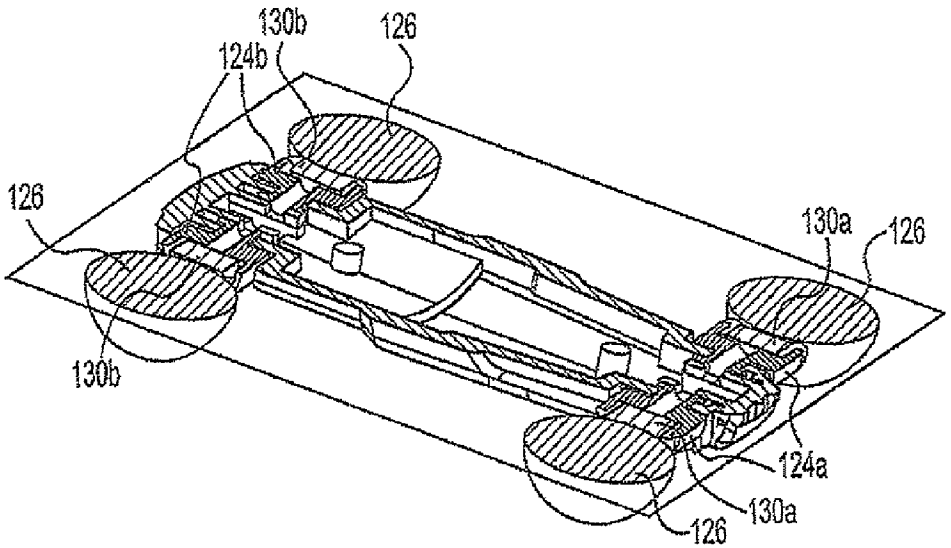
FIG. 2B is a schematic diagram that illustrates a cross-sectional perspective view of a self-assembling vehicle, in an embodiment of the present invention.
Figure 2A:
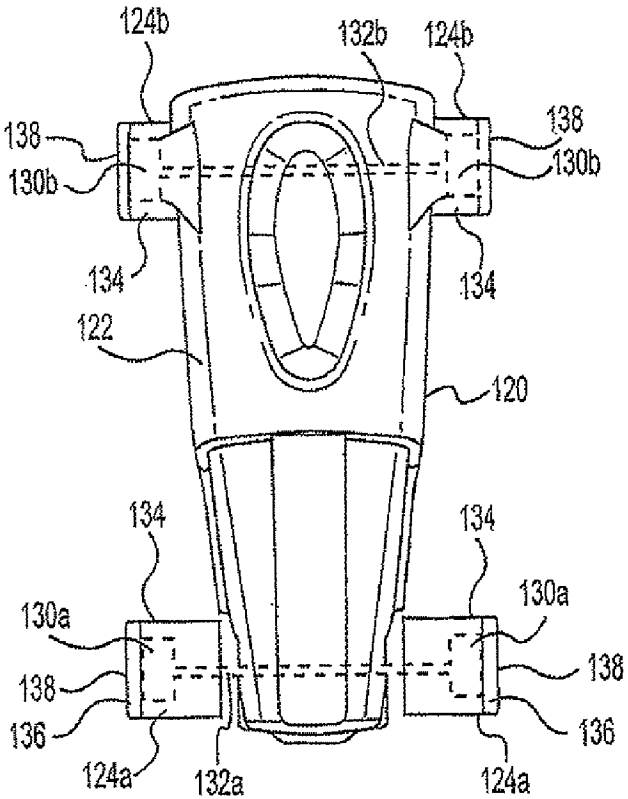
FIG. 2A is a schematic diagram that illustrates a top plan view of a self-assembling vehicle, in accordance with an embodiment of the present invention.

As further depicted in FIGS. 2A and 2B, which are a top plan view and cross-sectional perspective view, respectively, of one configuration of a vehicle 120, magnetic 124*a* and 124*b* can comprise cylinder magnets 130*a*, 130*b* whose axes are aligned along the direction of respective front and rear axles 132*a* and 132*b*, which can comprise a steel material. Magnets 130*a*, 130*b* can be made of any magnetic material, such that magnets 130*a*, 130*b* retain a permanent magnetization without the presence of an external magnetic field. Magnets 130*a*, 130*b* can thereby attract other magnets or ferromagnetic material when such objects are brought within proximity of magnets 130.

Axles 132*a* and 132*b* are each attached at both ends to a respective pair of magnets 130*a*, 130*b*. Although the axles and magnets can be separate, the continuous connection between the axles and magnets shown in FIG. 2A can provide beneficial flux characteristics and increase the magnetic force available to hold ferromagnetic or magnetic components. In one embodiment of the present invention, vehicle 120 is configured such that axles 132*a* and 132*b*, together with their respective cylinder magnets 130*a*, 130*b*, are fixed with respect to body 122 and do not rotate. In another embodiment of the present invention, vehicle 120 is configured such that axles 132*a* and 132*b*, together with their respective cylinder magnets 130*a*, 130*b*, can freely rotate along the axes of the axles with respect to body 122. Unless otherwise indicated, in the discussion below, the magnetic hubs are configured to rotate with respect to a vehicle body 122.

In the embodiment of the invention shown in FIG. 2A, magnetic hubs 124*a* and 124*b* include an optional housing 134, which can be a plastic material that encases magnets 130*a*, 130*b*.

Although axles 132*a* and 132*b* are each depicted as a single axle, in embodiments of the present invention, each magnet 130 could be configured to rotate on its own separate axle. Magnetic hubs 124*a* and 124*b* may optionally include a welded cap 136 that is welded to housing 134 over the magnet 130*a* or 130*b*.

As depicted in FIGS. 1A, 2A, and 2B, magnetic hubs 124*a* and 124*b* are located in outer regions of vehicle body 122, that is, the hubs form a part of the outer surface of vehicle 120 and can thereby contact components external to the vehicle.

In operation, rear axle 132*b* rotates in unison with respective magnets 130*b* and housing 134. Similarly, front axle 132*a* rotates in unison with respective magnets 130*a* and housing 134. Although FIG. 2A illustrates a configuration in which rear and front axles are about the same length, in other configurations of the invention, the front and rear axles may have different lengths. In addition, in accordance with other configurations of the invention, the plan view shape of body 122 can be more rectangular such that the relative protrusion of the axles 132*a*, 132*b* from body 122 is the same.

Referring again to FIG. 1A, as well as FIG. 2A, vehicle 120 is configured to accommodate a set of wheels 126 that attach to magnetic hubs 124*a* and 124*b* at respective outer cylinder head surfaces 138. As depicted in FIG. 2A, these surfaces 138 (also referred to as "cylinder tops") are substantially perpendicular to the rotation axis of the magnets represented by the longitudinal direction of axles 132*a*, 132*b*. However, in embodiments of the present invention, surfaces 138 are provided with a central shallow recess (not shown).

Wheels 126 can comprise cylinders or other suitable shapes, but preferably comprise spheres, as depicted in FIG. 1A. Wheels 126 can be a ferromagnetic material. The term "ferromagnetic," as used herein, refers to a material having a high positive magnetic susceptibility, that is, the ferromagnetic material generates a high internal magnetic field aligned in response to an external magnetic field, such as that induced by a strong magnet. Thus, a ferromagnetic material is capable of strong attraction to any permanent magnet. Accordingly, the magnetic field of the wheels becomes substantial and is aligned with an external magnetic field placed near spheres 126.

Preferably, spheres 126 comprise soft ferromagnetic materials (or soft magnetic), wherein the term "soft ferromagnetic materials" refers to the fact that the materials have a low remnant magnetization and low coercive field. The term "remnant magnetization" refers to the net internal magnetic field present in the material when an external magnetic field is removed. Thus, soft ferromagnetic spheres when removed from the presence of a strong magnet have low magnetic polarization such that their ability to attract other soft magnetic materials is weak. For example, a soft magnet sphere 126 when attached to a strong magnetic hub 124 will strongly attract a paper clip because the sphere has a strong magnetic field aligned with that of the hub. When detached and removed from the presence of a hub 124, a soft magnetic sphere 126 will only weakly attract a paper clip, because the internal remnant magnetic field in the sphere is weak. Many materials, such as many types of steel can be used as soft magnetic materials. Thus, although wheels 126 do not substantially attract each other, when wheels 126 are in the proximity of magnets 130*a* or 130*b*, the wheels are attracted to the magnets and vice versa.

The low coercive field associated with soft magnetic materials indicates that the direction of magnetic polarization of the soft magnetic material can be switched using a low external magnetic field directed opposite to the initial direction of polarization of the soft magnetic material. Thus, the direction of magnetization of a soft magnetic sphere can easily be switched when placed near a hard magnet. Thus, regardless of the direction of polarization of a soft magnetic sphere 126, when it is brought near a magnet in the hub 124, the magnetic polarization lines in the sphere 126 readily line up with that of the hub 124, without the sphere having to physically rotate.

However, in other embodiments of the present invention, the wheels 126 can comprise hard ferromagnetic materials, wherein the term "hard ferromagnetic material" refers to a ferromagnetic material that has a relatively high remnant polarization and a high coercive field. Thus, a hard magnetic material acts as a "magnet" all by itself, that is, in the absence of an external magnetic field, the hard magnetic material can strongly attract other magnetic materials whether those other materials are soft or hard magnetic materials. In the discussion to follow, unless otherwise noted, wheels 126 are made from soft magnetic materials.

When a set of wheels 126 is attached to body 122 at magnetic hubs 124*a*, 124*b*, vehicle 120 becomes operational and can be propelled forward on a surface. Because wheels 126 are magnetized when in proximity or in direct contact with magnetic hubs 124*a* and 124*b*, wheels 126 remain attached to respective magnetic hubs and rotate generally in unison with respective axles 124*a* and 124*b*. Preferably, vehicle 120 includes four wheels in an operational state, although embodiments of the present invention are contemplated in which a vehicle is operable with fewer than four wheels.

The terms "self assembly" and "self-assembling" magnetic toy refer (used interchangeably with the term "auto-assembly") to the property of a toy, such as vehicle 120, wherein component parts of the toy can mutually join together without a user having to physically bring the components into contact and/or align the components precisely. Thus, unlike many known vehicles that are designed to be manually assembled and/or disassembled, wherein a user has to align wheels with an axle and perhaps snap the wheels into place, embodiments of the present invention provide a vehicle whose wheels self-assemble onto the vehicle by merely bringing the vehicle body and wheels within a predetermined distance of each other.

Advantageously, by providing protruding magnetic hubs 124*a* and 124*b* on the sides of vehicle 120, and by employing ferromagnetic spheres that are preferably soft magnetic materials, embodiments of the present invention facilitate the self-assembly process. If placed on a common surface in proximity to each other, spheres 126 and body 122 can mutually move together, and come into contact. Because spheres 126 retain little or no permanent magnetic field in the absence of other magnets, the spheres are attracted substantially equally in any orientation to magnetic cylinders 130*a* or 130*b*.

In one embodiment of the present invention, magnets 130*a* and 130*b* are configured such that the strong magnetic direction is aligned with the cylindrical axis. Accordingly, spheres 126 tend to attach to outer surfaces 138 when in proximity to the magnets.

Preferably, magnets 130*a*, 130*b* are of sufficient strength, and spheres 126 are sufficiently ferromagnetic (that is, the positive magnetic susceptibility is sufficiently high) that spheres 126 are strongly held in contact to magnetic hubs 124*a*, 124*b*, even if magnets 130*a*, 130*b* are covered with a non-magnetic material.

One additional feature of assembled vehicle 120 provided by the embodiment of the invention depicted in FIG. 1A is the auto-alignment capability of the wheels. Unlike the case of conventional tires having a flat cylindrical shape, because wheels 126 are spherical, after any slight perturbation of the placement of the wheels on their axles, the wheels automatically return to alignment with a respective axle. In other words, if any displacement or rotation of the wheel with respect to a respective axle takes place, for the example, if a wheel rotates on an axis orthogonal to the axle rather than along the direction of the axle, the wheel still appears to be the same. This auto-alignment feature results in the ability of an assembled vehicle to maintain a straight trajectory after repeated use.

In embodiments in which hubs 124*a* and 124*b* comprise cylinder magnets and wheels 126 are soft magnetic materials, wheels 126 also tend to auto-align along the cylinder axis of a respective hub 124*a* or 124*b*. In other words, because the magnetic field along a cylindrical magnet tends to have circular symmetry with respect to the cylinder axis, a stable position results when the center of spheres 126 is along the axis of magnetic cylinder hub. Thus, the rotation axis of the spheres, which goes through the center of the spheres 126, tends to lie along the rotation axis of the magnetic hubs, providing for a smooth axle and wheel rotation, and smooth vehicle travel.

Figure 2C:
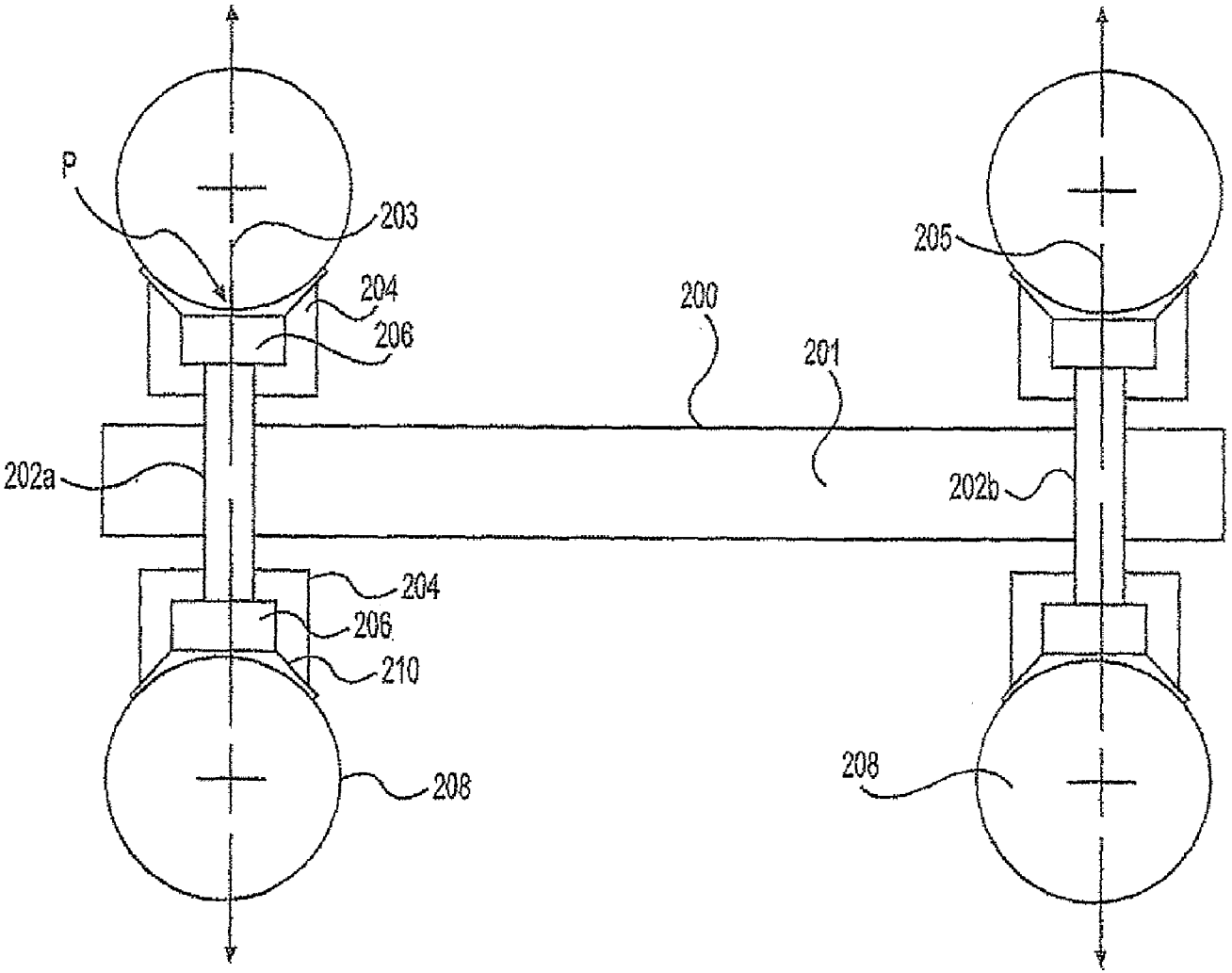
FIG. 2C is a schematic diagram that depicts a top cross-sectional view of a self-assembling vehicle, in accordance with an embodiment of the present invention.

FIG. 2C is a top cross-sectional view that depicts details of an auto-aligning vehicle 200, in accordance with another embodiment of the present invention. Body 201 includes two axles 202*a*, 202*b*, which are substantially parallel to one another and housed within body 201, such that axles 202*a*, 202*b* can freely rotate therein. Front axle 202*a* rotates around front axis 203, while rear axle 202*b* rotates around rear axis 205. Wheel hubs 204 each include a cylindrical magnet 206 whose axis coincides with a respective axis 203 or 205. When attached to body 201, each wheel 208 is horizontally aligned with its center along the respective axis 203 or 205. Thus, the rotation axis of each wheel tends to be horizontally aligned with a respective front or rear rotation axis.

As illustrated further in FIG. 2C, a circular or conical recess 210 can be provided on the outward face of each hub 204, which is useful to retain a spherical wheel, wherein the spherical wheel 208 can contact the magnetic hub along an entire circular rim of the recess, as opposed to a single point P in the case of a completely flat outer surface of the hub. This recess 210 further helps seat each sphere 208 so that the rotation axis of the sphere remains aligned both vertically and horizontally with the rotation axis of the respective axle. For example, although for cylindrical magnet configurations, the magnetic field of the magnets 206 may tend to align the center of each respective wheel 208 to the rotation axis 203 of the magnetic cylinder, the weight of a vehicle body 201 tends to lower the height of a magnetic hub contained therein.

Figure 2D:
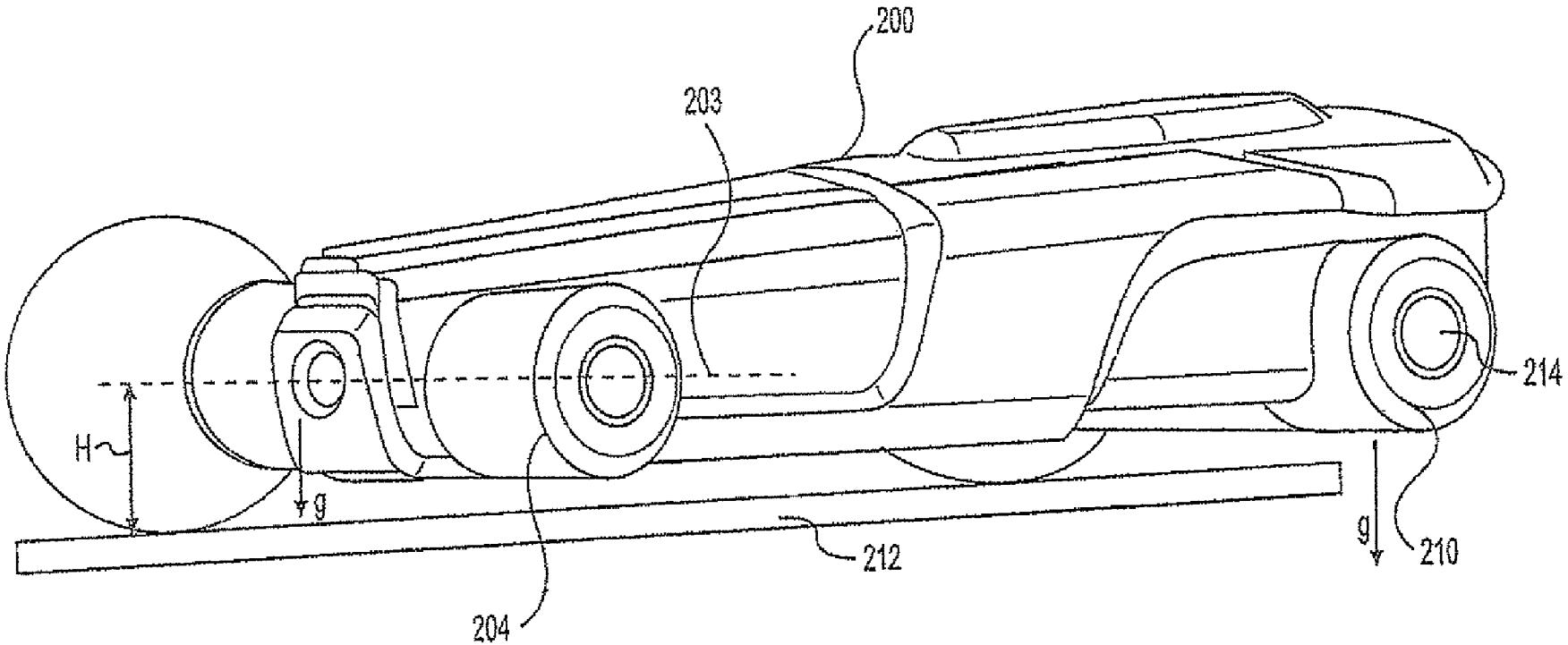
FIG. 2D is a schematic diagram that depicts a side perspective view of a partially assembled self-assembling vehicle, in accordance with an embodiment of the present invention.

FIG. 2D illustrates a perspective side view of a partially assembled embodiment of the vehicle 200 depicted in FIG. 2C, which indicates that the rotation axis of the hub 204 is maintained at a height H above the surface 212 upon which the vehicle 200 rests. Because the spheres 208 preferably have a larger diameter than the diameter of the magnetic hubs 204 to promote smooth operation of the vehicles, the bottom of hubs 204 are above the surface 212. The force of gravity g tends to pull body 201 towards surface 212. Accordingly, as the hubs 204 are attracted toward surface 212, the outward surfaces 214 of the hubs 204, if unconstrained, can slide down along the spheres 208 under the weight of vehicle body 201. To counteract this tendency, the recesses 210 prevent relative slippage of the center of the hubs by seating the wheels 208 along the axis of the hubs.

Referring again to FIGS. 2C and 2D, in embodiments of the present invention, the diameter of wheels 208 can be tailored, such that the clearance of body 201 above plane 212 is sufficient to allow a user to depress the body 201 downwardly toward plane 212, which causes a relative translation of body 201 with respect to wheels 208, causing wheels 208 to release from magnetic hubs 204. Accordingly, when a user "crushes" a vehicle body 201 in a rapid motion toward a plane 212, wheels 208 can be violently ejected from the body, adding to the play experience of a user.

In addition to embodiments in which wheels 126 are soft magnetic materials that retain little or negligible macroscopic magnetic polarization outside of an applied magnetic field, embodiments in which wheels 126 are permanent magnets are also possible. Although wheels that comprise permanent magnets generally have to align their own magnetic fields in accordance with the fields of the cylindrical magnets, this auto-alignment can take place so long as the wheels 126 can rotate freely to allow for magnetic alignment. Typically, such spherical permanent magnets will engage in greater rotation than for spherical soft magnetic materials, since the magnetic pole of a magnetic sphere randomly physically oriented and placed near a magnetic cylinder will not in general initially have the proper magnetic alignment. In addition, the magnetic field of the magnetic cylinder will typically not be sufficient to reorient the magnetic field of a permanent magnet sphere, so that a sphere that is not properly magnetically aligned with the hub will not be attracted to the hub. Accordingly, in order to perform attachment of wheel to the hub, the sphere, hub, or both may have to physically move and/or rotate. Thus, the process of alignment of sphere to hub may involve more movement and/or more time in the case of a spherical permanent magnet as compared to a soft magnetic sphere. As another embodiment, however, to avoid the need for alignment, wheels comprising permanent magnets could be used with ferromagnetic (instead of magnetic) hubs.

In any case, whether permanent magnets are provided for wheels or not, the auto-assembly and auto-alignment processes may be accompanied by sound as the wheels attach to the respective magnetic hubs (e.g., a snapping sound).

Accordingly, vehicle 120 can provide a user with added enjoyment when the wheels "snap onto" the body when brought nearby without the user taking any special effort to align the wheels or vehicle body. It will be apparent that the predetermined distance over which the wheel self-alignment process can take place can vary according to the strength of the permanent magnets 130*a*, 130*b* and the magnetic susceptibility of the wheels, as well as the friction of the surfaces on which the vehicle components are resting. However, in preferred embodiments of the present invention, this distance can be in the range of several millimeters to several centimeters.

In addition, in accordance with embodiments of the present invention, the self-assembly process can be modified by choice of the configuration of the magnetic poles of the magnetic hubs 124*a*, 124*b*. In one embodiment of the present invention, vehicle 120 is configured with like poles facing outwardly for all hubs 124*a*, 124*b*. It is to be noted that when two ferromagnetic spheres are introduced in proximity of each other and in proximity but not precise alignment with adjacent cylindrical magnetic hubs, the magnetic interaction is such that the tendency of the spheres to each properly attach to respective magnetic hubs can depend on the local magnetic field, especially that between the adjacent hubs. This local magnetic field depends both on the relative polarity of the adjacent hubs, and the relative distance between the hubs, as well as the diameter of the spheres, and size of the cylindrical magnets.

For assembly of vehicles 120 without use of an assembler 110 (see discussion below), to facilitate self-assembly, for a given separation between axles, it may therefore be preferable to configure the polarity of the magnetic hubs in a predetermined manner, based upon empirical observation or simulation as to that configuration where auto-assembly occurs the most often.

Additionally, for assembly of vehicles 120 with the aid of assembler 110, configuration of the polarity of the hubs of a vehicle according to a designed pattern can aid in assembly of vehicles. In one embodiment of the present invention, a plurality of vehicle bodies 122 is configured such that all magnetic hubs have the same polarity in a given vehicle body, and such that the polarity of the hubs in each vehicle is the same as that of all of the other vehicles to be stacked in assembler 110. Accordingly, vehicle bodies 122 tend to repel each other when stacked in assembler/launcher 110. Thus, the hubs in a vehicle body 122 located in an assembly position in assembler 110 tend to magnetically repel those in the vehicle body immediately above, instead of attracting hubs of another vehicle in the case where the polarity of hubs in one vehicle was opposite that of the vehicle above. The magnetic repulsion may be sufficient to counteract the force of gravity, such that one vehicle body 122 floats above a body 122 in the assembly position immediately below. This leads to a more facile self-assembly process of wheels to a vehicle body, one vehicle at a time and without sticking to each other, since the vehicle bodies are not attracted to each other, and a separation by magnetic repulsion can be maintained between adjacent vehicle bodies 122.

In other embodiments of the present invention, the polarity of the magnetic hubs of toy bodies can be arranged to vary the manner in which a plurality of magnetic toys interact with each other. For example, a first and second toy body could be arranged such that all the hubs have the north pole (arbitrarily defined, and not defined with respect to the magnetic north pole of the earth, whose magnetic field is negligible in comparison to magnets of the toys in the present invention) facing outwardly. Accordingly, such toys, for two-axle automobiles, tend to repel each other when the hubs with attached wheels come into proximity with one another. Alternatively, a first vehicle could be arranged with all north poles facing outwardly in the axle hubs, while a second vehicle is arranged with all south poles facing outwardly in the axle hubs. When two such vehicles are brought into physical proximity, they will tend to attract each other. Accordingly, the tendency to crash cars and the intensity of crashes can be varied in accordance with configurations of the present invention.

Other combinations of hub polarity are also possible according to other embodiments of the present invention. For example, a first vehicle could be configured with the left side hubs having south poles outwardly facing, while the right side hubs have north poles facing outwardly; the front axle of a first car could be configured with north poles facing outwardly while the rear axle is configured with the south poles facing outwardly; etc.

In accordance with still other embodiments of the invention, the interactions between separate magnetic vehicles can be further varied by providing permanent magnet spheres as wheels, in which case the intensity of repulsion or attraction between wheels in separate vehicles can be enhanced.

In one embodiment of the present invention, two or more magnetic vehicles can be used in conjunction with one or more tracks that guide the vehicle travel. For example, two magnetic vehicles can be placed facing each other in a single track designed to restrict the motion of a vehicle to be either forward or backward along the track. When sent towards a head-on collision, the severity of the collision could either be increased or decreased in accordance with the design of the polarity of the magnetic hubs in the front axles of the respective vehicles, as well as the proximity of the front axles to the front of the vehicle.

In another example, a pair of vehicles could be placed upon separate tracks that run parallel to each other and/or come into close proximity to one another at predetermined points, such that a pair of vehicles could be guided to closely approach one another in separate tracks. By choice of polarity of the magnetic hubs in the respective vehicles, the tendency of the vehicles to attract or repulse one another upon close approach could be varied, such that one or more of the vehicles could be forced to "jump" a track.

In another example, two vehicles traveling in the same direction on a single track could have adjacent axles (e.g., the rear axle of the front vehicle and the front axle of the rear vehicle) with like polarities, such that the rear vehicle could push the front vehicle along the track by magnetic repulsion, without actually contacting the front vehicle. In this manner, the rear vehicle would appear to magically push the front vehicle along the track.

Referring again to FIG. 2C, in another configuration of the present invention, an axle 202*a* or 202*b* and its corresponding hubs 204 can be configured as a removable unit, such that the magnetic polarity of the hubs in vehicle 200 can be rapidly changed by swapping axles having different hubs with different magnetic configurations. Alternatively, hubs 204 themselves could be removable, reversible, and/or interchangeable to provide different polarities.

Referring again to FIG. 1A, in the embodiment of the present invention depicted therein, assembler 110 is configured to facilitate assembly of a magnetic toy that has the shape of a vehicle, such as vehicle 120. Assembler 110 includes central, or "main," chamber 112 that is configured to receive a vehicle body from the top of assembler 110 and house one or more vehicle bodies 122. As used herein, the term "chamber" generally refers to the walls as well as the region contained within the walls of the chamber. Assembler 110 also includes a set of outer chambers 114 that are each configured to receive and house one or more wheels, such as spheres 126. For example, in one embodiment of the present invention, main chamber 112 can house up to three vehicle bodies 122 at a given time. Similarly, in one embodiment, each chamber 114 can house up to three spheres 126 at the same time. Accordingly, assembler 110 can house vehicle parts from which a plurality of vehicles can be assembled.

In one aspect of the invention, a user can place an assembled vehicle 120 at the top of assembler 110, and dislodge wheels 126, such that the separate vehicle components 126 and 122 are received in respective outer compartments 114 and central compartment 112, respectively. Alternatively, a user can simply separately place vehicle components in the respective chambers. Assembler 110 can be configured such that vehicles are assembled at an assembly position 115 located, for example, in an assembly chamber near the bottom of assembler 110. Accordingly, assembled vehicles exit assembler 110 at ramp 117 provided at the bottom of assembler 110. Preferably, when more than one vehicle body is stacked within compartment 112, and sufficient wheels are stacked within outer compartments 114, each time a vehicle is assembled and exits assembler 110, a vehicle body and set of wheels immediately on top of the respective vehicle body and wheels just assembled take the place of their assembled counterparts.

In embodiments of the present invention, the exit of an assembled vehicle 120 from assembler 110 can be facilitated by different means. For example, one embodiment of the present invention involves provision of a ramp at the assembly position of a vehicle 120, that causes the assembled vehicle to roll forward out of the assembler 110 due to the force of gravity. Other means for facilitating vehicle exit include, for example, an ejector that strikes, pushes, or flings an assembled vehicle. Other means for facilitating vehicle exit that can be used in conjunction with gravity of an ejector include moving a movable barrier that is configured to block vehicle movement in a first position, which barrier, when moved or retracted, allows the vehicle to move forward under the action of gravity or an ejector.

FIG. 1A depicts an embodiment of the present invention in which assembler 110 further includes optional launcher 116, described in detail further below. Launcher 116 is configured to propel assembled vehicles 120 from the body of assembler 110, wherein the assembled vehicles exit through ramp 117.

As described in detail below, in embodiments of the present invention, assembler 110, which is also termed an assembler/launcher, or just launcher, is configured to facilitate self assembly of a vehicle having magnetic components. In one embodiment of the present invention, chambers 112 and 114 comprise at least in part, transparent walls that allow a user to view at least portions of vehicle bodies 122 and wheels 126 being housed, lowered, assembled, and ejected from assembler/launcher 110. Thus, a user is provided with a view of a vehicle assembly and launch process while operating the assembler/launcher 110.

Figure 10A:
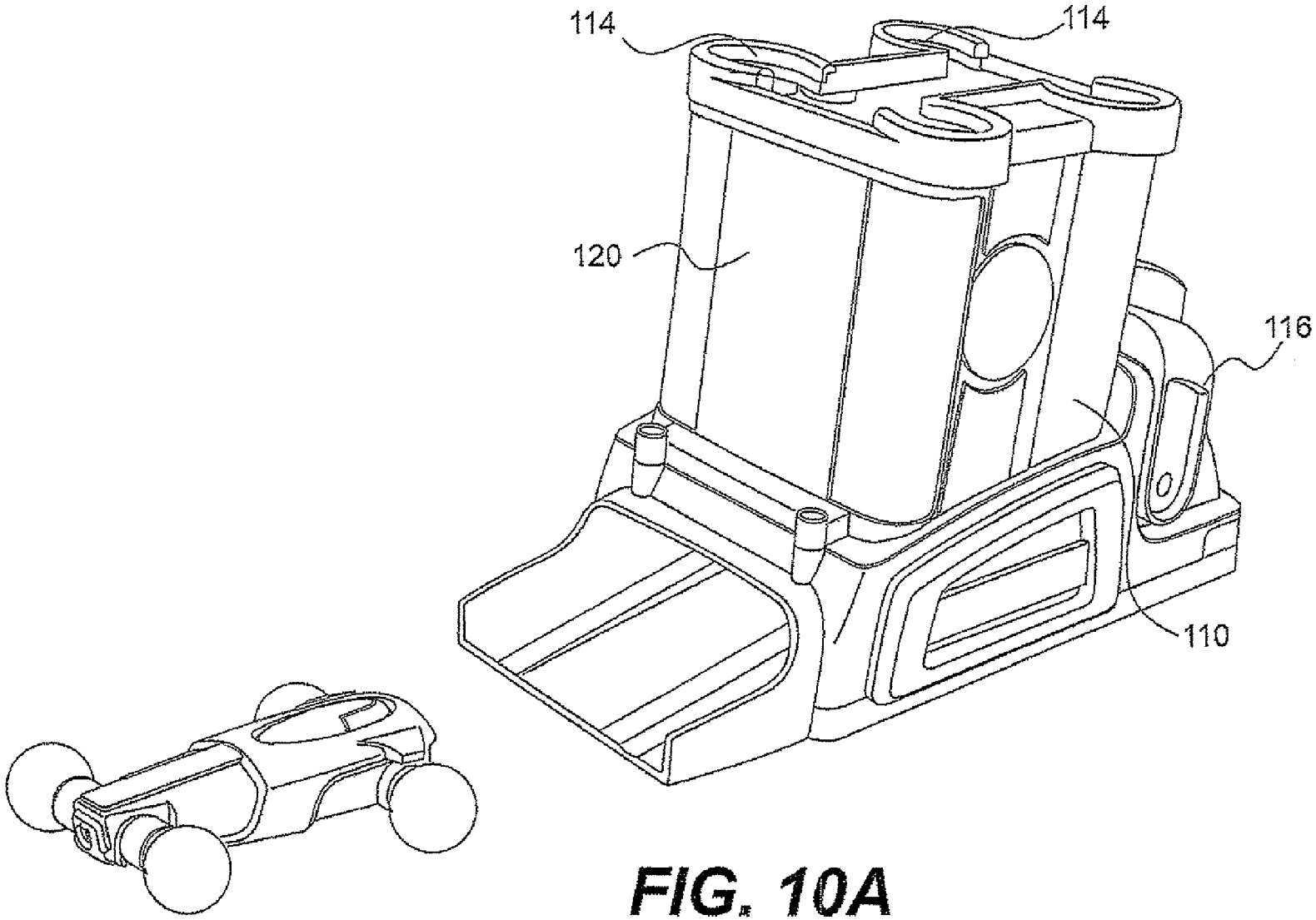
FIGS. 10A-10C are schematic diagrams that depict the positioning of vehicle parts in a toy assembler/launcher, in accordance with an embodiment of the present invention.
Figure 10B:
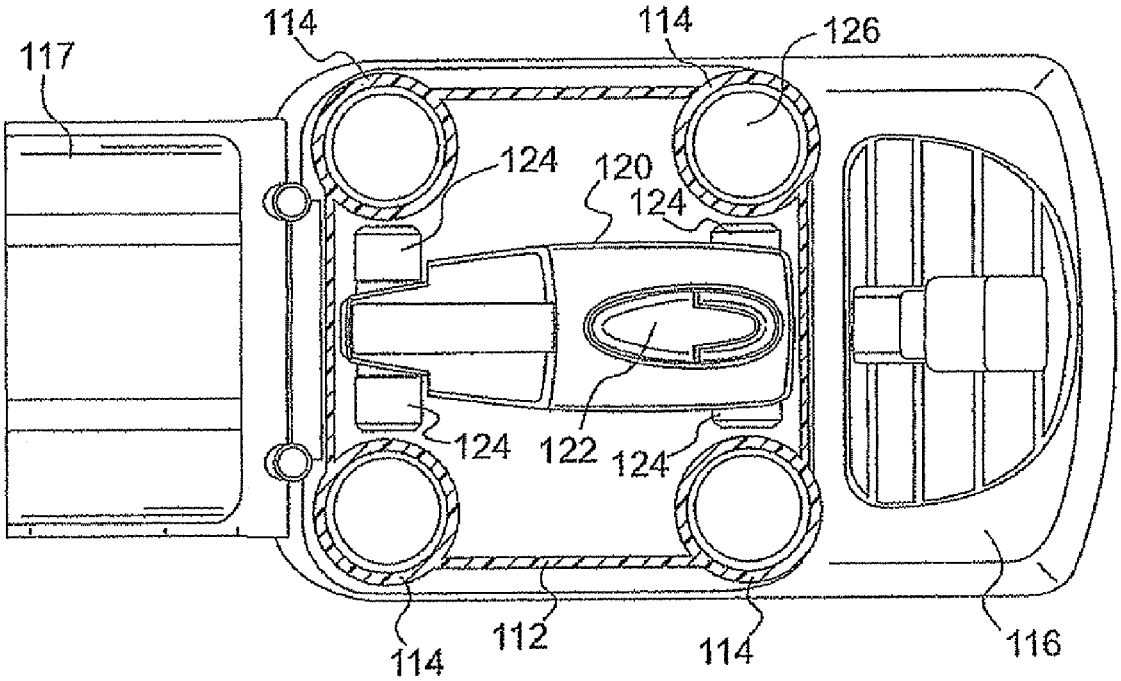
Figure 10C:
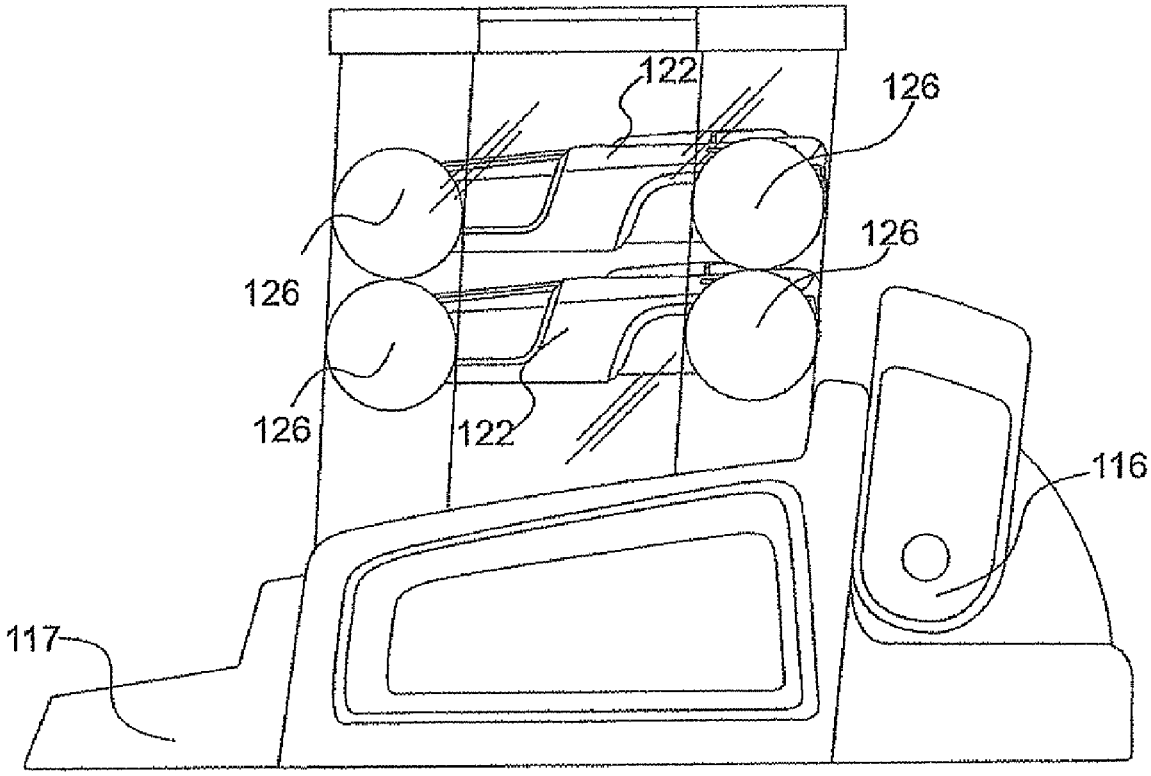

FIGS. 10A-10C depict the positioning of vehicle parts in assembler/launcher 110 before assembly, in accordance with an embodiment of the present invention. At least an upper portion of each wheel chamber 114 is physically isolated from vehicle body chamber 112, such that wheels 126 do not directly contact a vehicle body 122 placed in the chamber above the assembly position (not shown), which lies toward the lower portion of assembler/launcher 110. For example, in accordance with an embodiment of the present invention, each wheel chamber 114 can comprise a transparent or translucent cylinder having walls that completely surround a wheel 126, at least in an upper portion of the cylinder. Accordingly, a user can place a set of four magnetic wheels, one in each wheel chamber 114, that come to rest at the same level in assembler/launcher 110.

For assembly of an additional magnetic vehicle 120, a set of an additional four wheels, one in each wheel chamber 114, can be placed to rest upon a corresponding first magnetic wheel in each wheel chamber 114. Each set of four wheels is consequently arranged at a given level of assembler/launcher 110. One or more vehicle bodies 122 (2 bodies are depicted in FIGS. 10A-10C) can be placed in a stack formation within vehicle body chamber 112. In accordance with embodiments of the present invention, the arrangement of magnetic hubs of vehicle bodies 122 and the placement of magnetic wheels 126 in chambers 114 can be used to promote the appearance of levitation of vehicle bodies 122.

In accordance with one embodiment of the present invention, the polarity of the hubs 124 is arranged to be the same for vehicle bodies 122 loaded into chamber 114. Because of this arrangement, a vehicle body 122 that is lowered upon a lower vehicle body 122 tends to be repelled by the lower vehicle body 122 when the hubs of the upper vehicle body 122 approach the hubs of the lower vehicle body. This can cause the upper vehicle body 122 to be repelled by the lower vehicle body 122 to the extent that the vehicle bodies when stacked in chamber 112 do not contact one another.

In addition, the dimensions of chamber 112 can be arranged to allow the wheels hubs 124 to come into close proximity with magnetic wheels 126 in chambers 114. By arranging the width of the vehicle axles to be close to the width of vehicle body chamber 112, the hubs 124 extend close to the inner side of wheel chambers 114 and can exert a strong attraction to wheels 126 that are disposed within adjacent wheel chambers 114, as depicted in FIG. 10B. However, the walls of wheel chambers 114 prevent the wheels 126 from contacting vehicle bodies 122. Accordingly, as depicted in FIGS. 10B and 10C, to a user viewing assembler/launcher 110, a stacked vehicle chassis (body) 122 can be seen to float inside the launcher body chamber 112 at approximately the same level as a corresponding set of wheels 126 that are housed in separate chambers 114.

When multiple vehicle bodies 122 and multiple sets of magnetic wheels 124 are stacked in assembler 110, the effect of the attraction exerted between magnetic wheels 126 in chambers 114 and hubs 124 of a first vehicle chassis 122 in chamber 112 on the one hand, and the mutual repulsion of the first vehicle chassis 122 and a second vehicle chassis 122 on the other hand, may be additive or may be in competition with each other depending on the relative strength of the magnets in the hubs, the size of the wheels 126, and the number of vehicles stacked in assembler 110, among other factors. For example, in accordance with embodiments of the present invention, the relative size of wheels 126 and height of vehicle bodies 122 can be increased to enhance the separation distance in which one vehicle body 122 floats over another vehicle body 122. For example, the diameter of spherical wheels 126 can be arranged to be greater than the height of vehicle bodies 122. Thereby the hubs 124 of the upper vehicle body 122 may tend to align close to the plane of the set of upper wheels so that the upper vehicle body 122 does not directly contact the lower vehicle body 122. However, depending on the magnitude of the repulsive force exerted between the upper and lower vehicle bodies, when no wheels are present in chambers 114, the vertical distance between adjacent vehicle bodies 122 in chamber 112 may be greater or lesser than the size of the wheels. Accordingly, when wheels 126 are stacked in chambers 114, the attraction between vehicle hubs 124 in an upper chassis 122 and upper wheels 126 may tend to increase or decrease the distance between the upper and lower bodies 122.

In addition, stacking of a third vehicle body 122 on top of a second vehicle body 122 may decrease the distance between the second vehicle body 122 and the first vehicle body 122, due to the mutual repulsion between second and third bodies 122, which tends to force the second vehicle body 122 in a downward direction.

As described further below, once an ejector mechanism is engaged, the vehicle chassis 122 and wheels appear to magically assemble and launch out of assembler/launcher 110.

FIGS. 3A-3H depict in a cutout perspective view various stages of operation of toy assembler 110, wherein toy assembler 110 acts to assemble and launch vehicle 120.

Figure 3A:
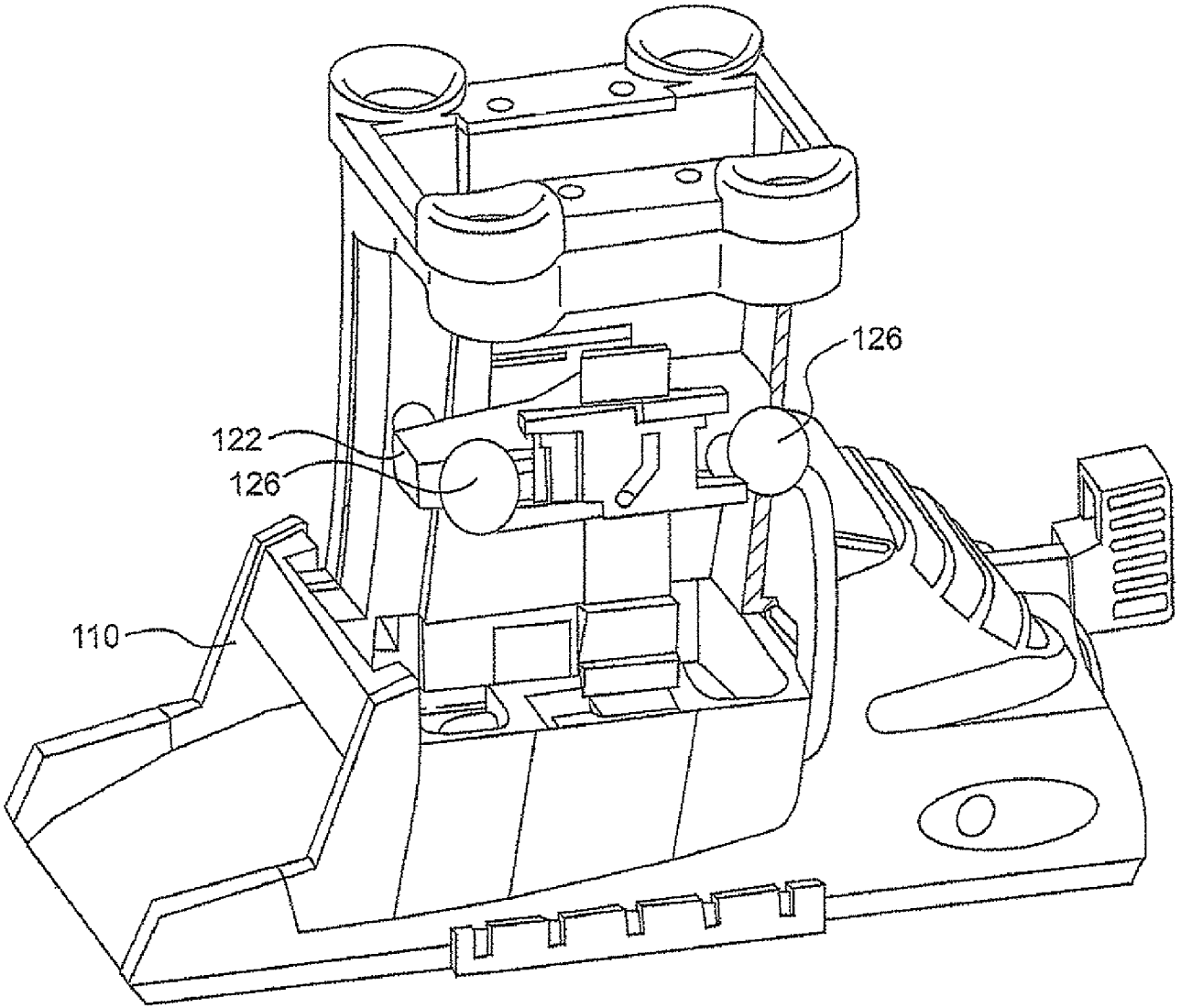
FIGS. 3A-3H are schematic diagrams that depict in cutout perspective view various stages of operation of a toy assembler/launcher, in accordance with an embodiment of the present invention.
Figure 3B:
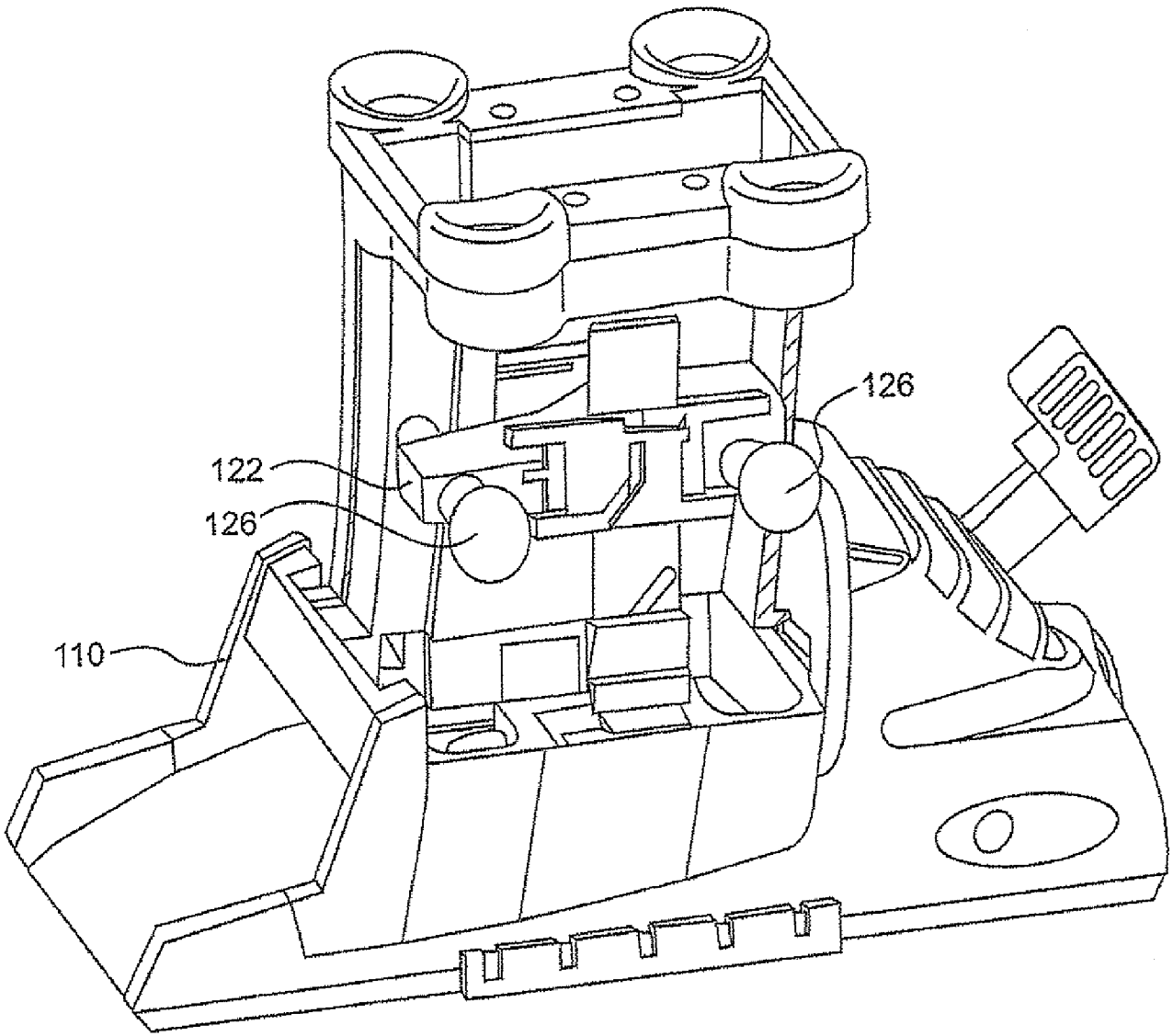

FIG. 3A depicts an early stage in which a vehicle body 122 and wheels 126 are housed in separate chambers (not shown for clarity) above an assembly position. For example, wheels 126 could be housed in chambers similar to chambers 114 while body 122 is housed in a chamber similar to chamber 112. In addition, one or more bodies 122 can be stacked above body 122 and one or more sets of wheels 126 can be stacked above wheels 126.

Figure 3C:
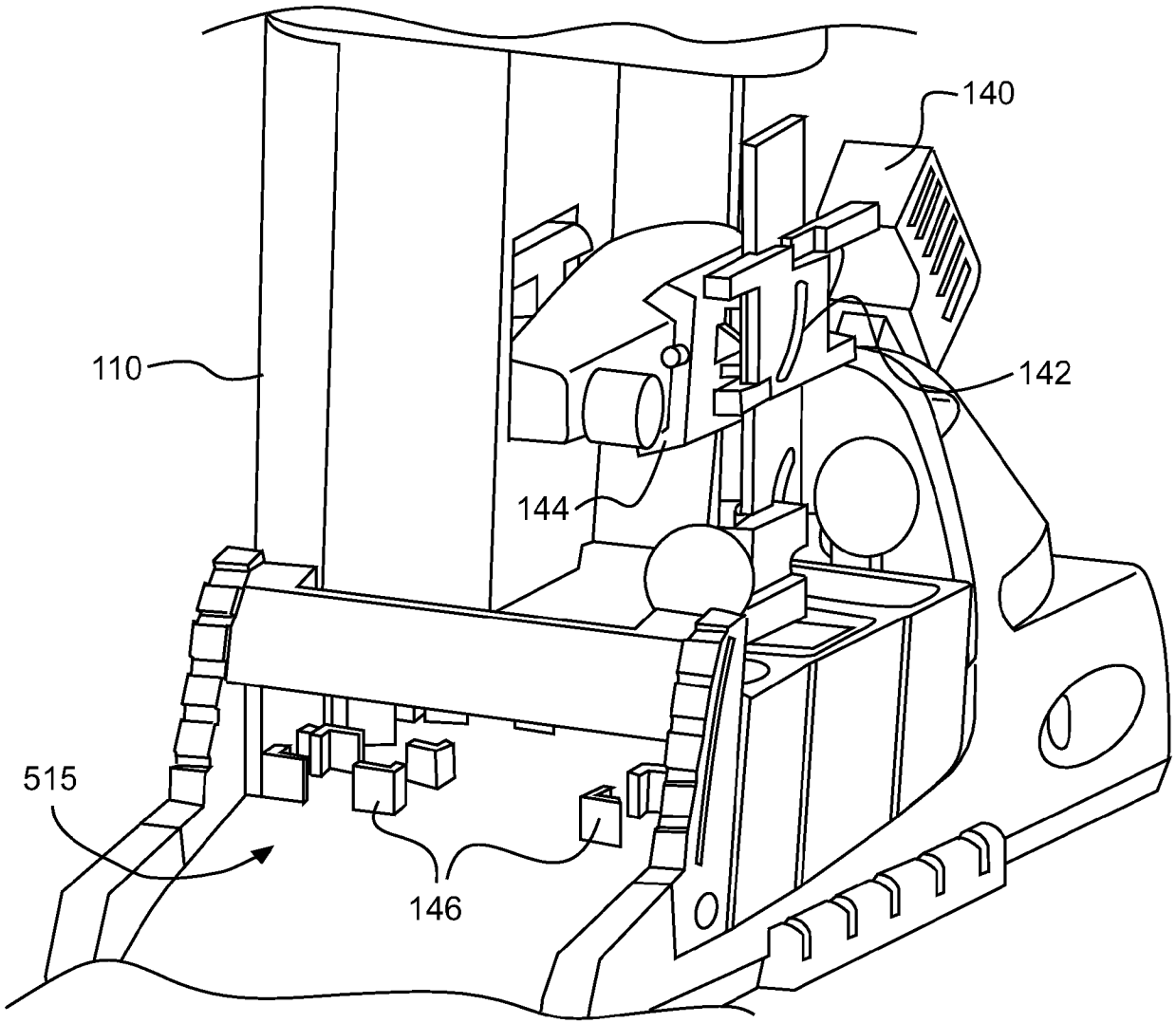

Referring also to FIG. 3C, wheels 126 are retained by holders 142, while vehicle body 122 is retained by holder 144.

Figure 3D:
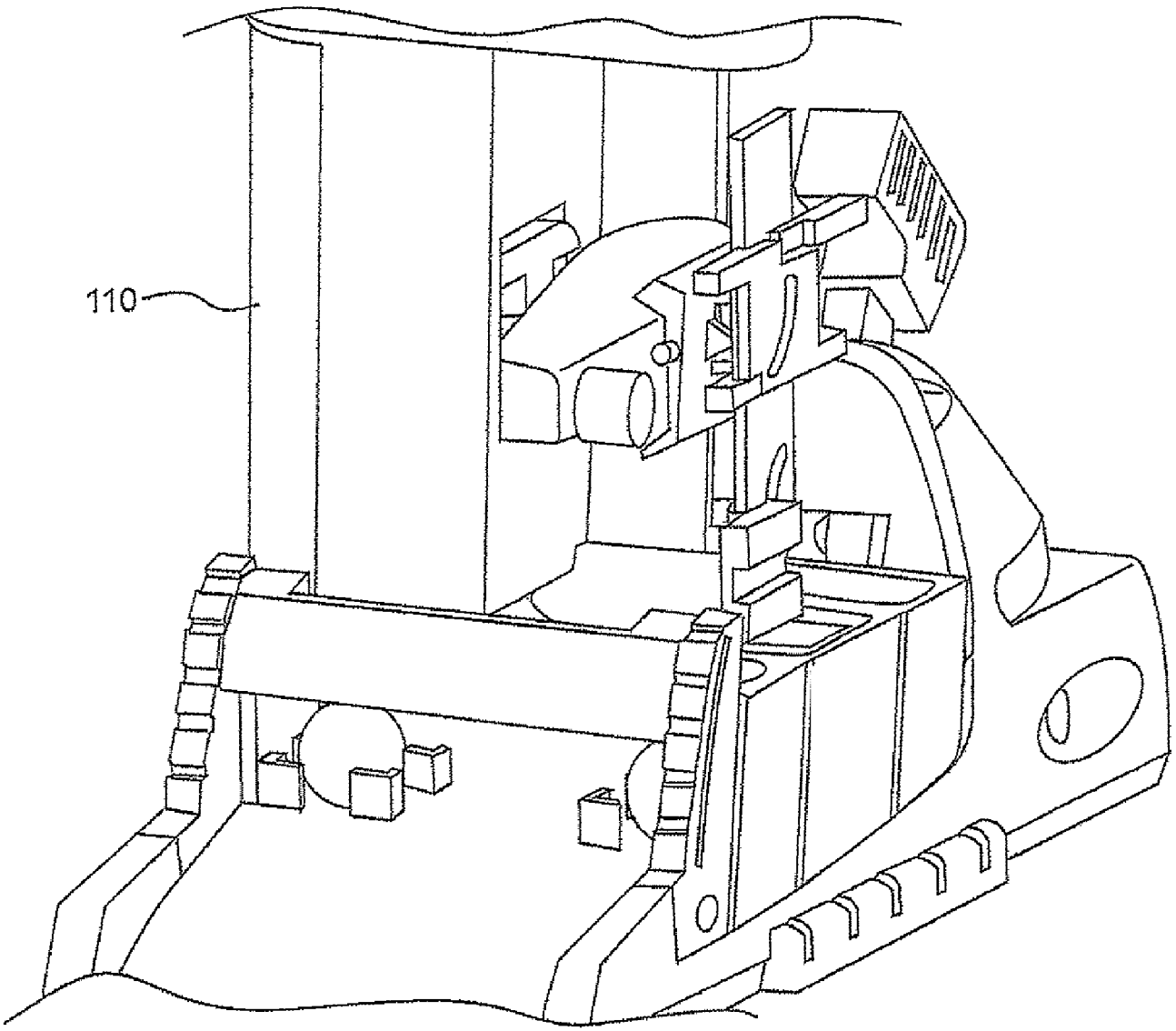
Figure 3E:
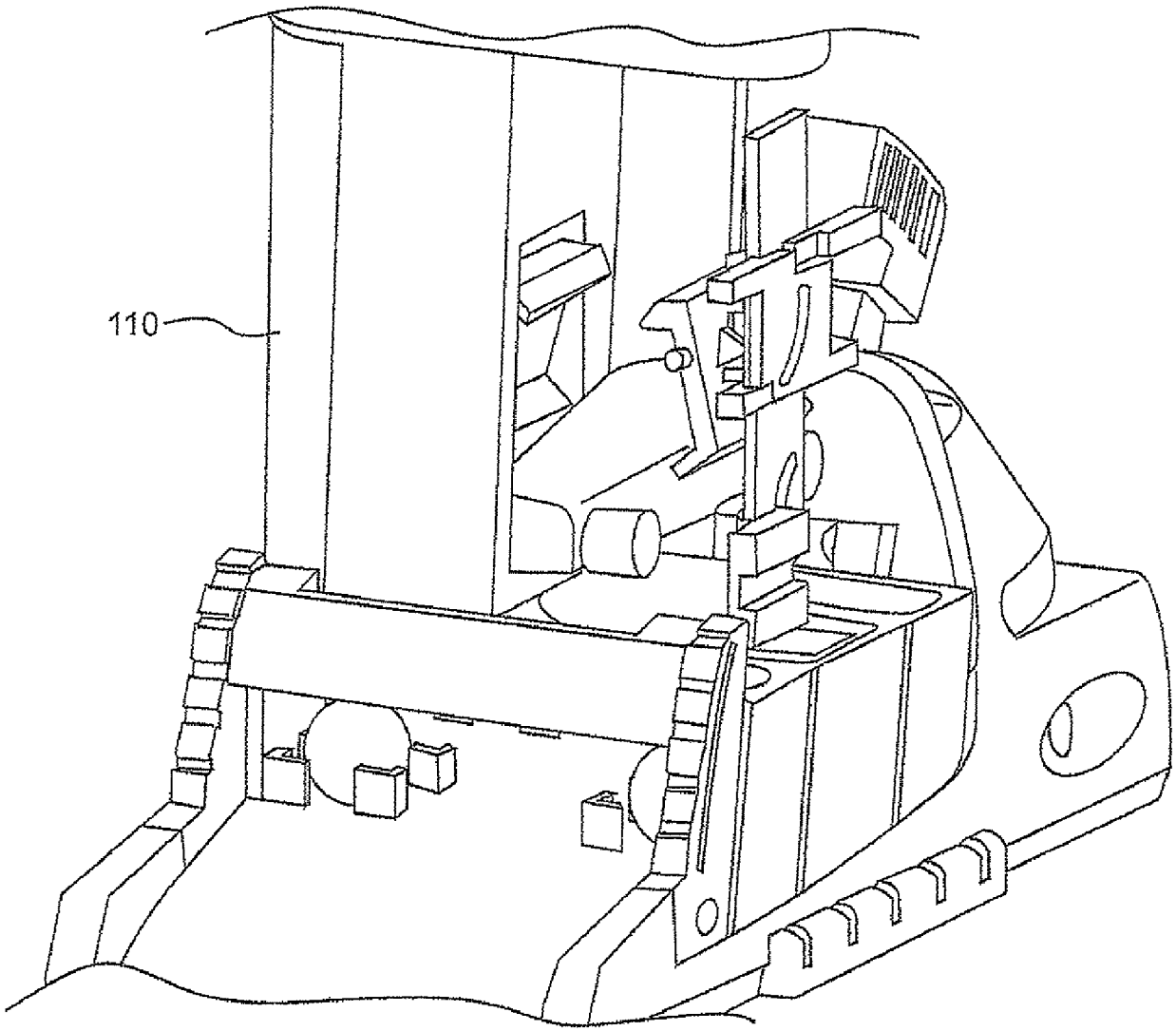
Figure 3F:
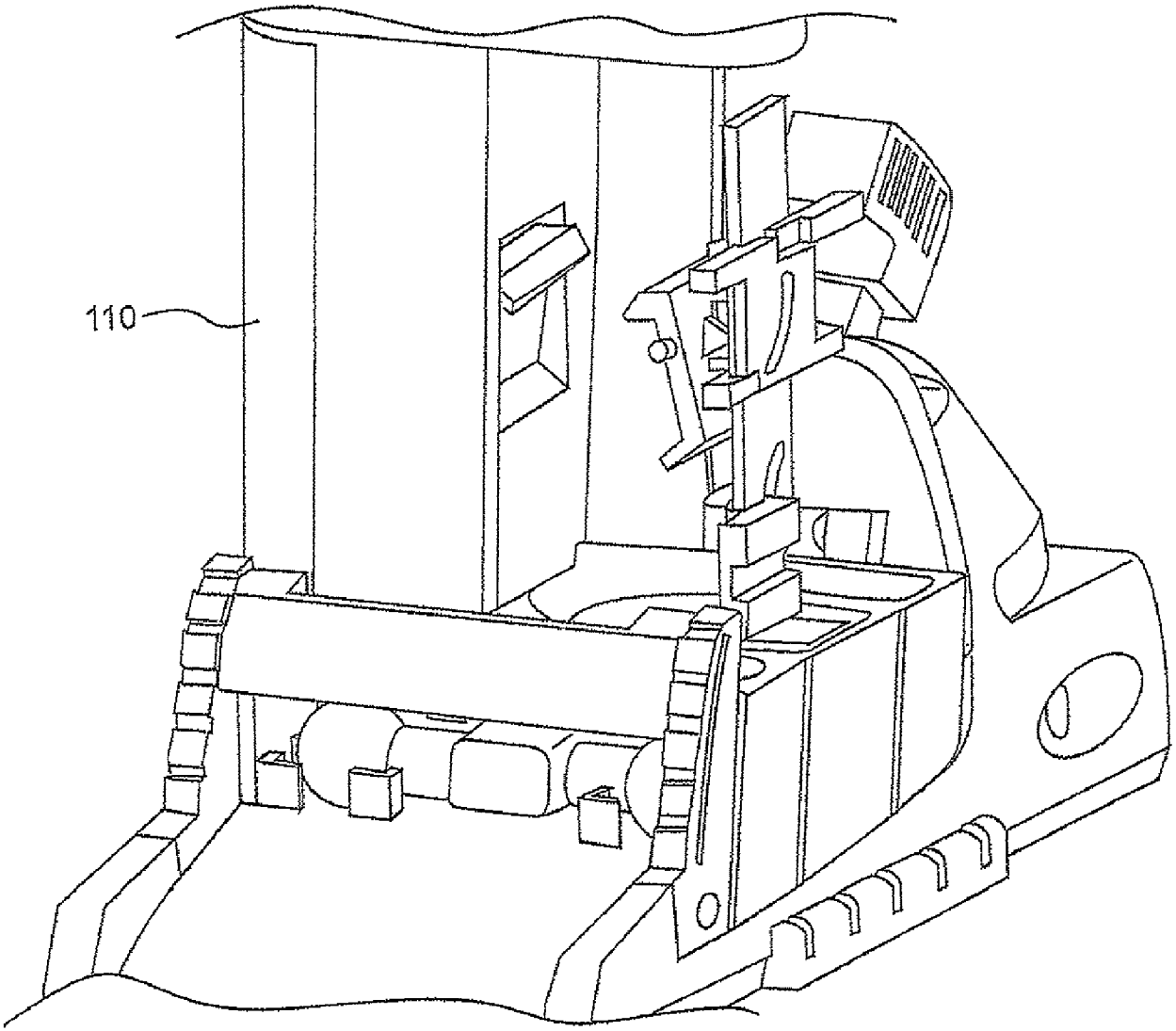

As depicted in the series of sequential views of FIGS. 3B-3F, when lever 140 is rotated upwardly, a series of motions is initiated in assembler 110. Holder 142 is moved along a direction parallel to the long direction of the vehicle, to retract holder 142 and release wheels 126, which fall into an assembly position at the bottom of the assembler 110. Subsequently, further upward rotation of lever 140 causes holder 144 to retract by rotating along an axis parallel to the long direction of the vehicle, thereby releasing the vehicle body 122, which falls to an assembly position, as depicted in FIG. 3F.

In the assembly position, vehicle body 122 and wheels 126 are brought into proximity to each other, without any barriers in between, wherein the self assembly process described above can take place. The relative lateral distance between the wheels and body can vary in different embodiments, such that the wheels travel a relatively greater or lesser lateral distance before attaching to the vehicle body, thereby creating a relatively greater or lesser sound, for example. To ensure that the vehicle wheels assemble to the body, the bottom surface below chambers 114 can be configured to slant toward a central region containing a vehicle body.

Figure 3G:
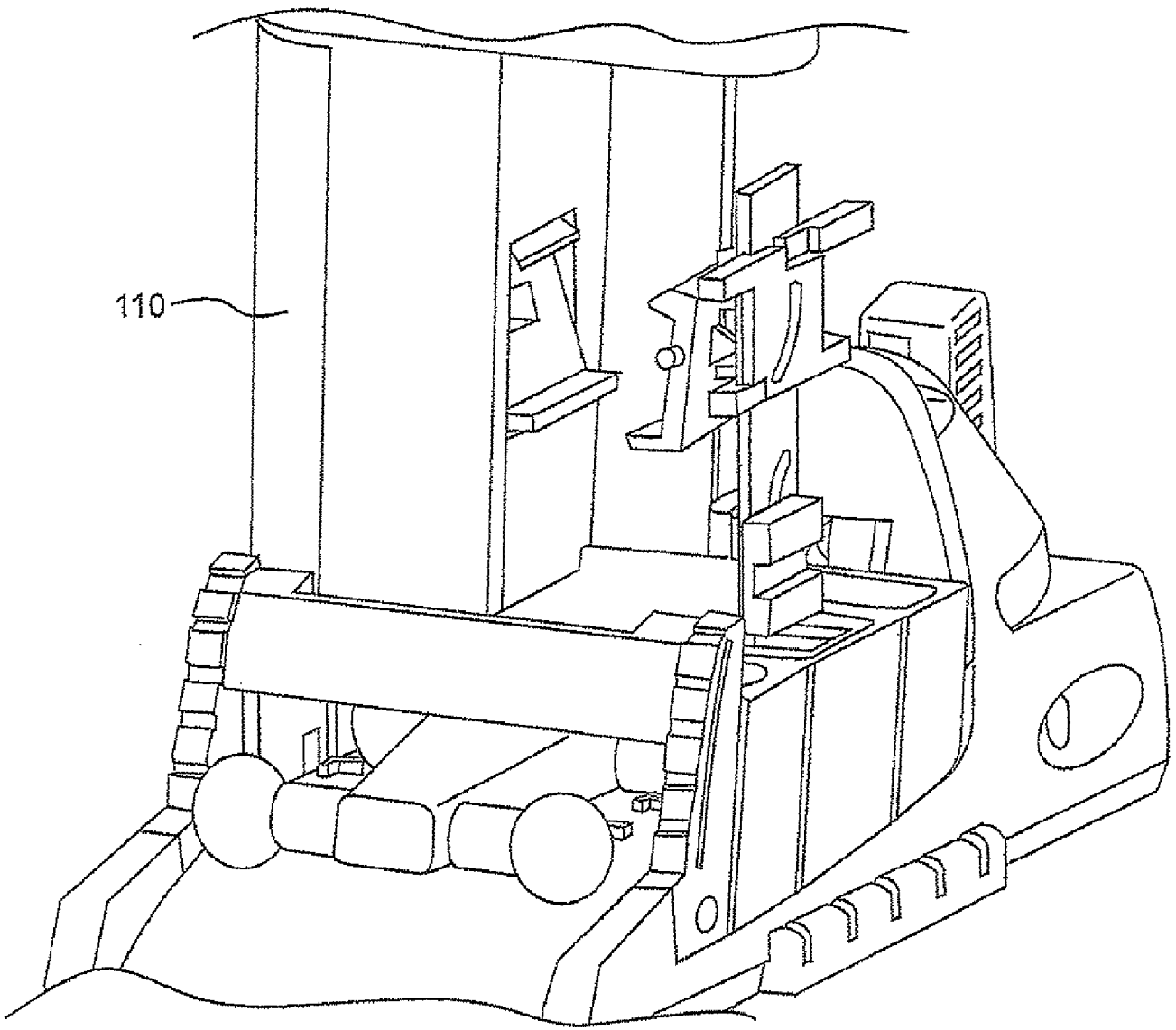
Figure 3H:
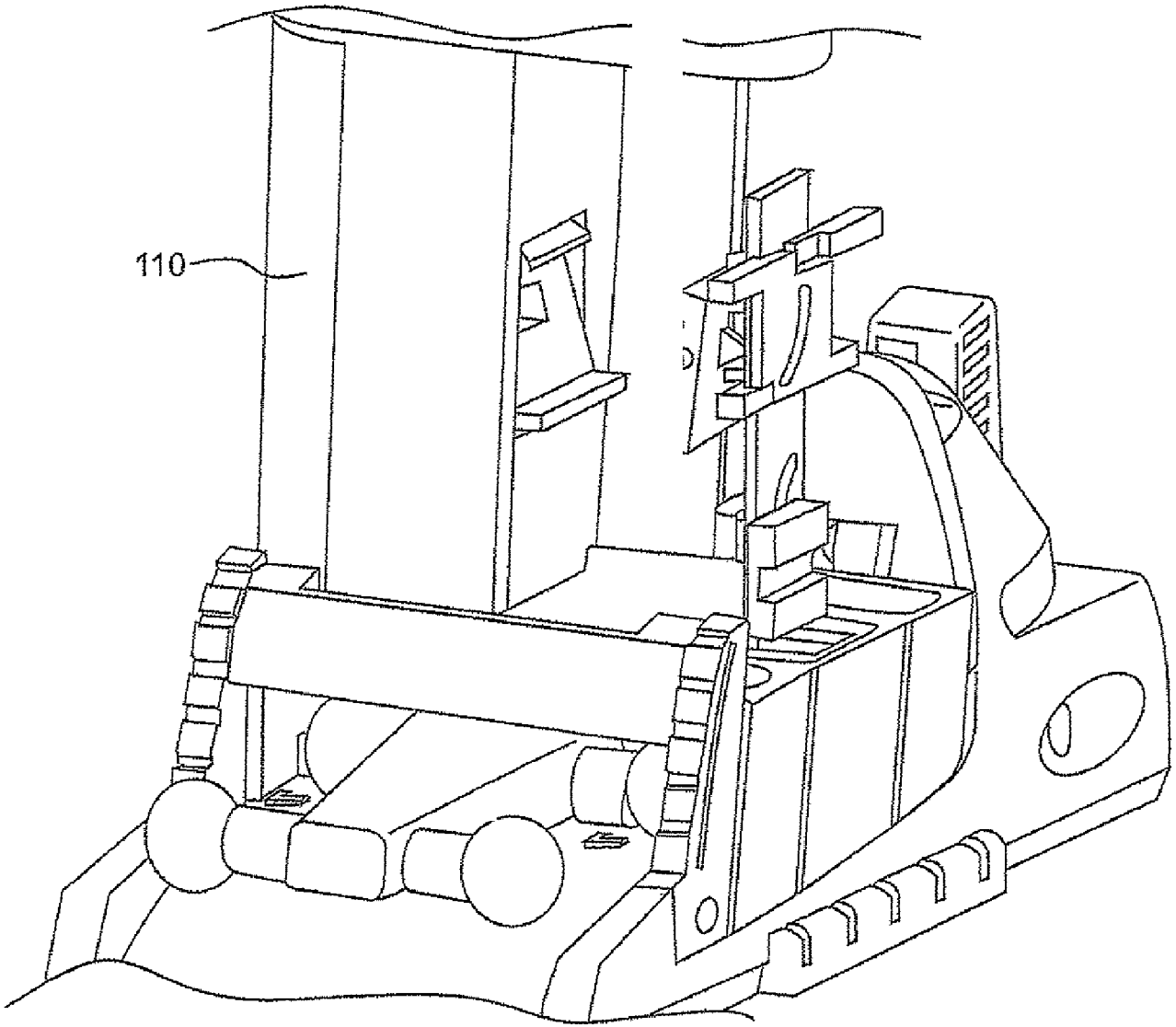

FIGS. 3G and 3H depict subsequent steps in which the lever 140 is rotated downwardly, causing barriers 146 to lower, and an ejector means (not shown) to launch the assembled vehicle forward along ramp 117.

Accordingly, a single lever 114 acts to facilitate assembly and ejection of a vehicle. Because the wheels 126 are configured to self assemble to body 122, as discussed above, the assembler/launcher 110 provides a robust means to repeatedly assemble and propel vehicle using a simple to and fro motion of a lever, without the user having to meticulously arrange vehicle parts, thus providing a unique interaction with toy vehicles.

Figure 11A:
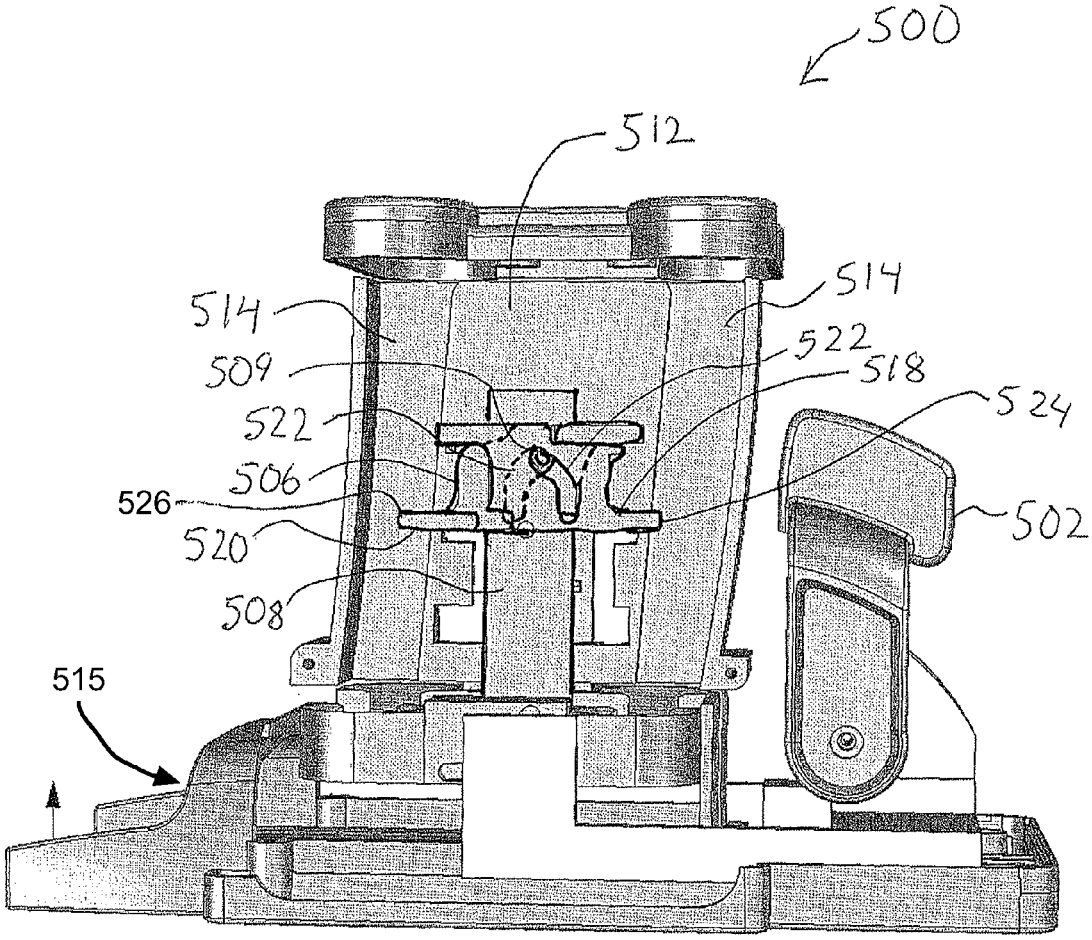
FIG. 11A is a schematic diagram that depicts a side cross-sectional view of a multiple vehicle assembler/launcher configured to assemble and launch vehicles in a two step motion of a lever, in accordance with another embodiment of the present invention.

In accordance with another embodiment of the present invention depicted in FIG. 11A, a multiple assembler/launcher 500 is configured to assemble and launch a vehicle 120 (not shown) in a two step motion of lever 502. When lever 502 is in a fully upward position, a first vehicle chassis 122 and set of wheels 126 placed in assembler 500 are held by holder 506 in a holding position in respective vehicle body chamber 512 and wheel chambers 514. When lever 502 is moved fully downwardly, wheels 126 and vehicle chassis 122 in the holding position are released by movement of holder 506 (described further below) into an assembly chamber 515 in which self-assembly of the first vehicle chassis 122 to magnetic wheels 126 takes place generally as described above with respect to FIGS. 3A-3H. At the same time, a launch/release device (not shown) is set in the assembly chamber. When lever 502 is moved upwardly, the launch/release device is triggered (not shown), which causes the assembled vehicle 120 to launch out of assembler 500. At the same time, holder 506 is returned to the holding position, which allows a second vehicle chassis 122 and wheels 126 (if any) that were previously stacked above the first vehicle chassis 122 and wheels 126 to fall into the holding position in respective vehicle body chamber 512 and wheel chambers 514. This two step process can be repeated for as many sets of vehicle parts as are loaded into assembler 500.

Figure 11B:
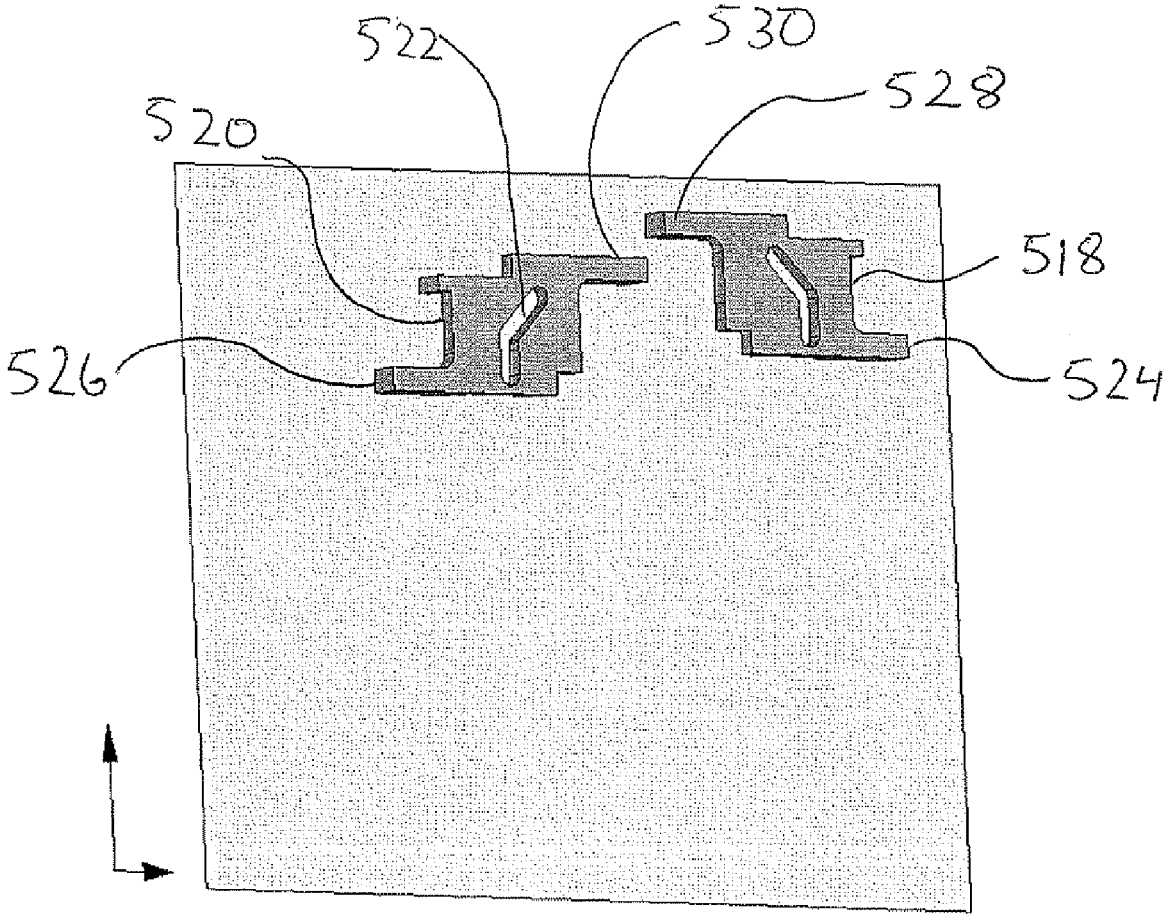
FIG. 11B is a schematic diagram that depicts exemplary components of the holder of the assembler/launcher of FIG. 11A.
Figure 11C:
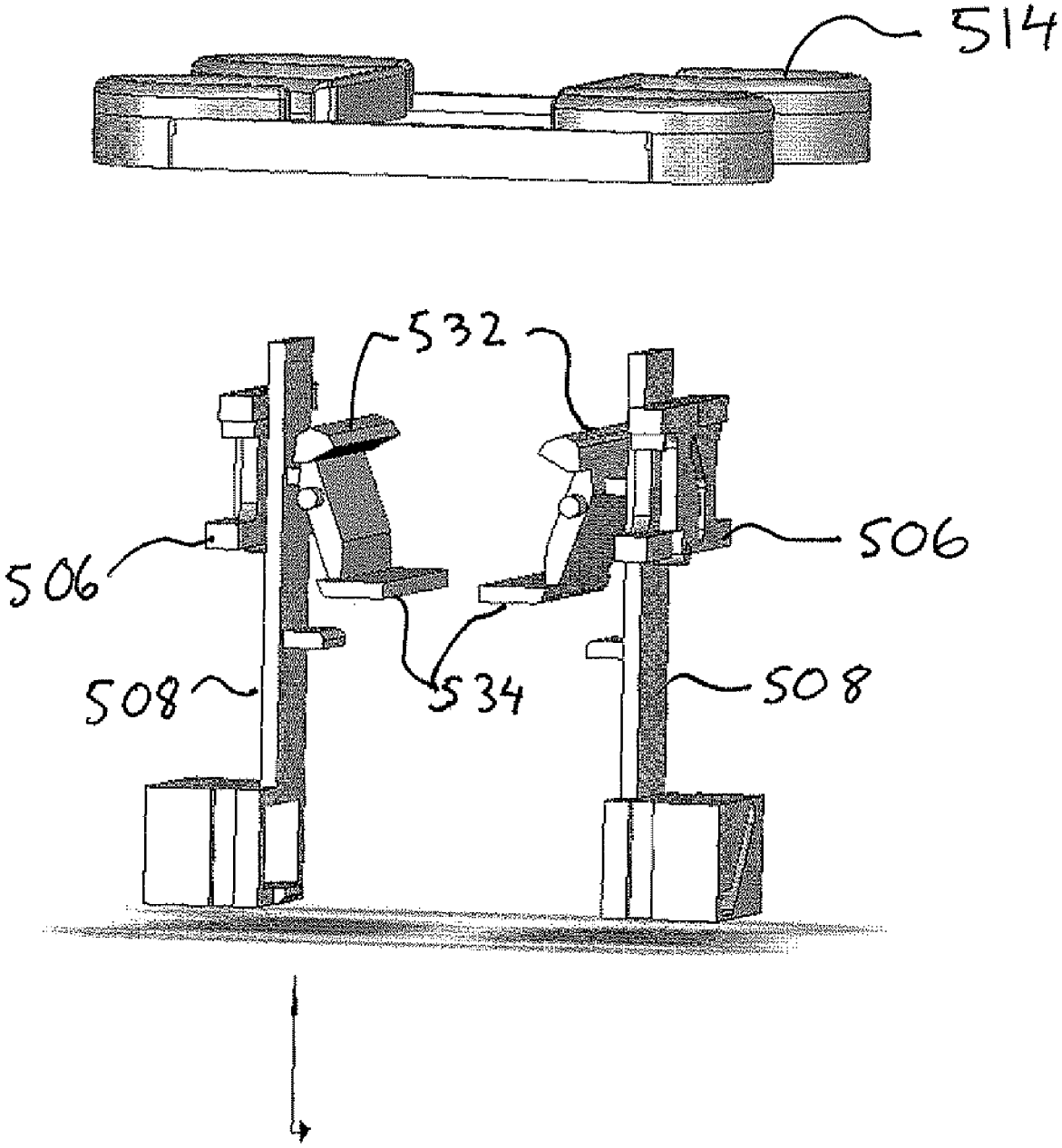
FIG. 11C is a schematic diagram that depicts a perspective view of wheel chambers and a holder of the assembler/launcher of FIG. 11A, in accordance with an embodiment of the present invention.

FIGS. 11B and 11C depict details of holder 506 in accordance with an embodiment of the present invention. In accordance with embodiments of the present invention, each of two sides of assembler 500 is configured with a similar holder 506. As discussed further below, each holder acts upon vehicle body 122 and upon two wheel chambers 514. A drive member 508 in each holder 506 is configured to move up and down in a generally vertical direction when lever 502 is rotated upwardly and downwardly, respectively. Outer and inner lateral members 518 and 520, respectively, are configured to be slidably moveable with respect to one another in a horizontal direction. As depicted in FIG. 11B, each of the lateral members 518 and 520 is generally shaped as a dog leg, and each includes a shallow V-shaped slot 522 that faces in a different direction to its counterpart. Drive member 508 includes pin 509 that extends within each V-shaped slot 522. Lateral members 518 and 520 include lower distal portions 524 and 526, respectively, and upper distal portions 528 and 530, respectively, each of which is configured to extend into a wheel chamber 114.

As depicted in FIG. 11A, upward vertical movement of pin 509 causes the lower portion of V-shaped slots 522 to be moved away from one another, placing the lower distal portions 524 and 526 away from one another, and causing each to substantially extend into a respective wheel chamber 514. In this "holding" position, upper distal portions of 528 and 530 are retracted from extending into chambers 514, thereby allowing any wheels stacked above to enter the holding position and rest against lower distal portions 524 and 526.

When pin 509 is fully extended downwardly, the lower portions of each slot 522 are lined up one on top of the other, and the lower distal portions 524 and 526 are brought into closest proximity to one another. In this "release" position (not shown), the holding position is empty, since lower distal portions of 524 and 526 are retracted from extending into chambers 514, thereby releasing any wheels to the assembly position below. In addition, the upper distal portions 528 and 530 extend substantially into a respective wheel chamber 514, preventing any wheels stacked above from entering the holding position.

Referring to FIG. 11C and again to FIGS. 3C-3E, in accordance with an embodiment of the present invention, holder 506 further comprises a vehicle holder 532 having a similar shape and action to that depicted for holder 144 in FIGS. 3C-3E. When drive member 508 moves fully upward as in FIGS. 11A and 11C, a lower portion 534 of the vehicle holder 532 extends inwardly into vehicle chamber 512, preventing vehicles from falling into the assembly position below, as generally depicted by the position of member 144 in FIG. 3C. When drive member 508 moves fully downwardly, the lower part of the vehicle holder rotates outwardly away from chamber 512, as generally depicted by the position of member 144 in FIG. 3E. Thus, any wheels 126 in chambers 514 and vehicle chassis 122 in chamber 512 are released to the assembly position when drive member 508 moves fully downwardly. One notable difference between the action of embodiments of the present invention depicted in FIGS. 3A-3H and those depicted in FIGS. 11A-11C is that the release lever moves upwardly to release components from the holding position in the embodiments shown in FIGS. 3A-3H, and moves downwardly to release components in the embodiments of FIGS. 11A-11C.

In accordance with embodiments of the present invention, a plurality of launchers 110 can be employed simultaneously by a plurality of users to launch a plurality of vehicles towards one another. As described above, the interaction between separate magnetic vehicles can be varied by choice of polarity of magnetic hubs on a vehicle. Thus, two separate vehicles could be launched from separate launchers toward one another with the severity of the collision varied according to the magnetic polarity of the front axle hubs, for example. Users could each launch a series of vehicles of varying magnetic hub polarity, such that the collision results between successive pairs of vehicles varies in a rapid fashion as the vehicles are launched at each other.

Figure 1B:
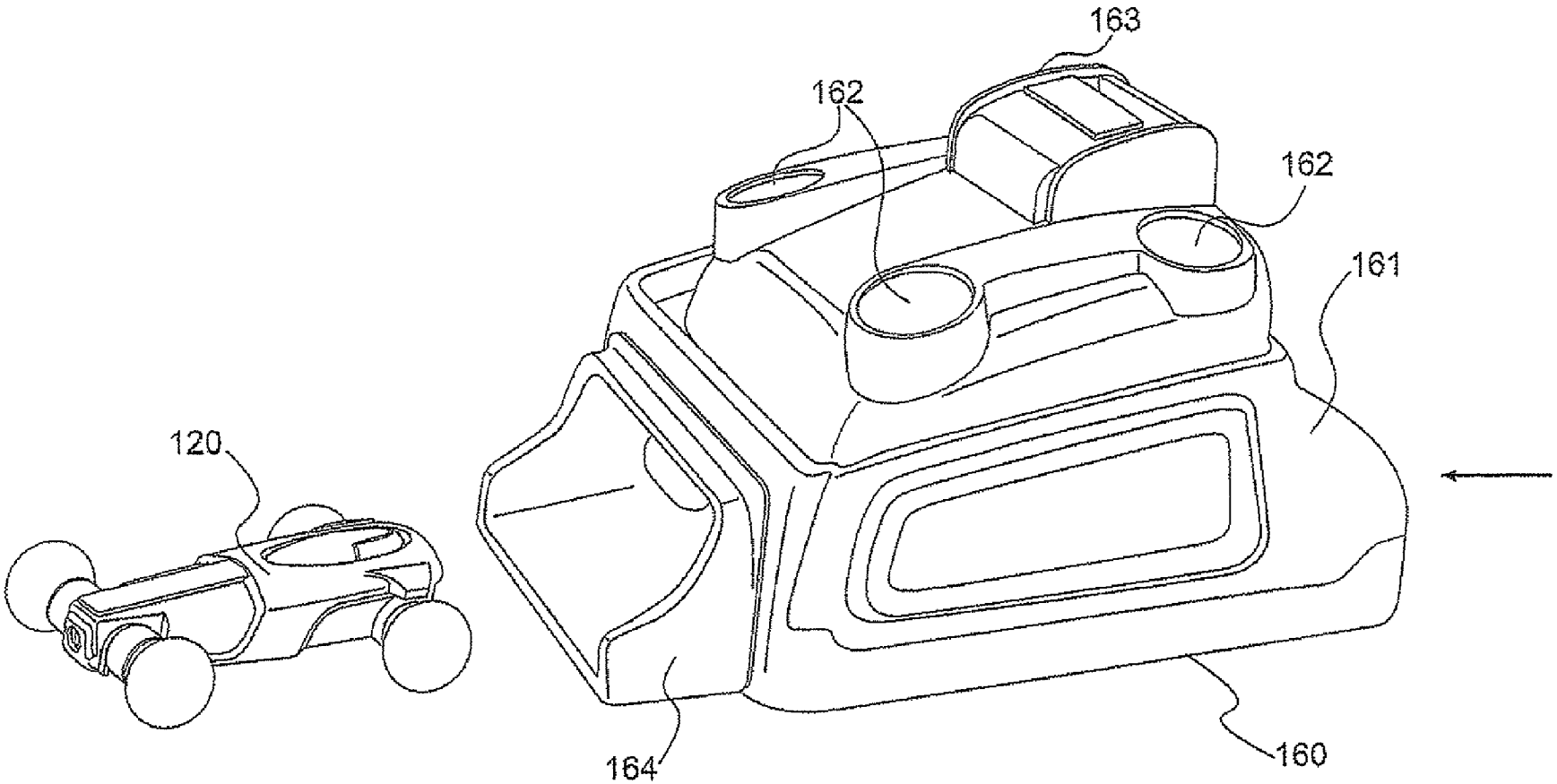
FIG. 1B is a schematic diagram that illustrates a vehicle assembler/launcher and a representative vehicle, in accordance with another embodiment of the present invention.

FIG. 1B illustrates a vehicle assembler/launcher 160, in accordance with another embodiment of the present invention. Launcher 160 is configured such that the body of a vehicle 122 is fed into a chamber in launcher 160 horizontally from an entry 161 in the back. Wheels are fed in through wheel chambers 162 provided on the top of launcher 160, such that the vehicle body 122 is surrounded by the wheels in chambers 162. A launch pump 163 is provided on the top of launcher 160, such that, when depressed, the vehicle 120 is assembled and an assembled vehicle 120 is launched out of exit ramp 164 provided in the front of launcher 160. As with assembler/launcher 110, launcher 160 takes advantage of the magnetic self-assembling properties of wheels 126 and vehicle bodies 122, as described above.

Figure 1C:
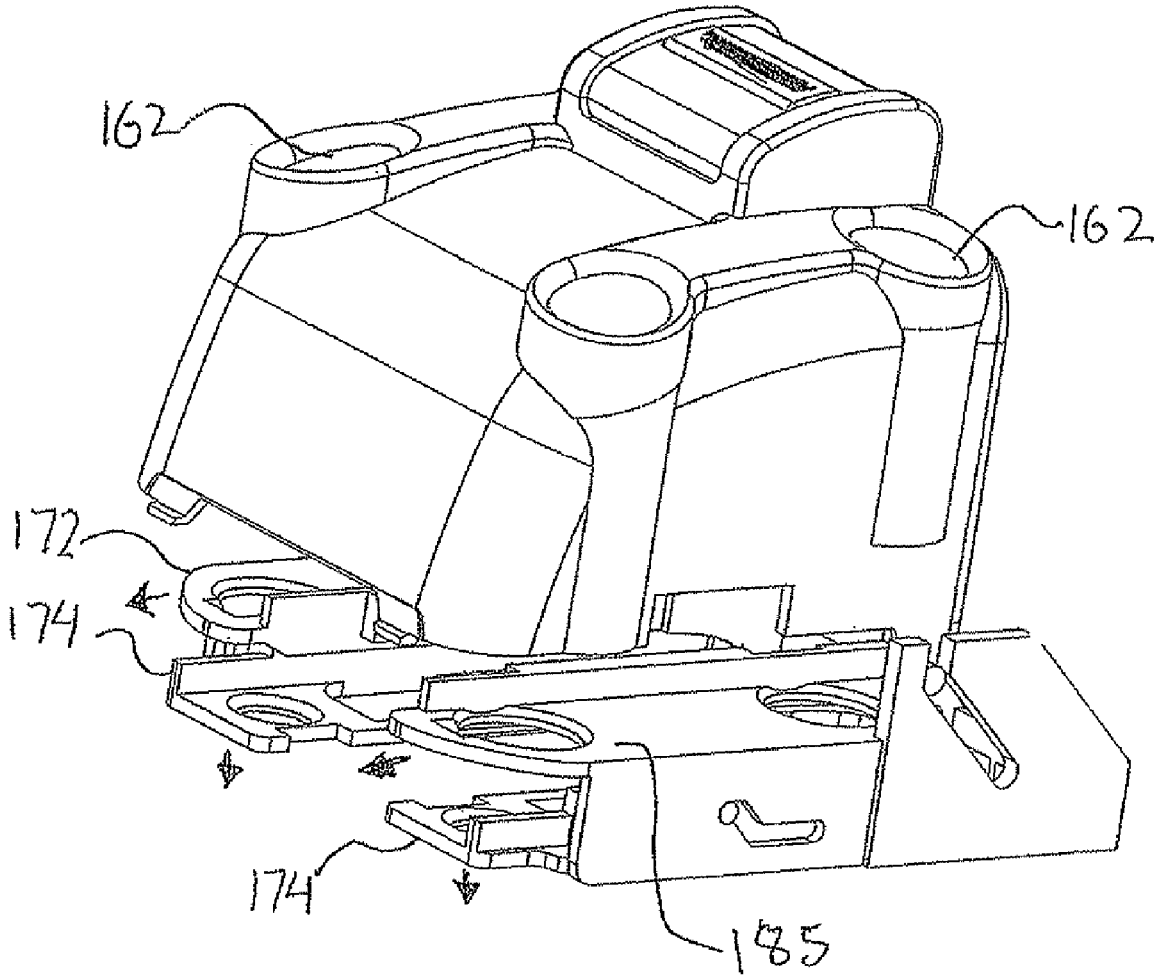
FIG. 1C is a schematic diagram that depicts in perspective view exemplary features of the assembler of FIG. 1B, in a retracted position, with outer portions of the assembler removed to show inner mechanisms.
Figure 1D:
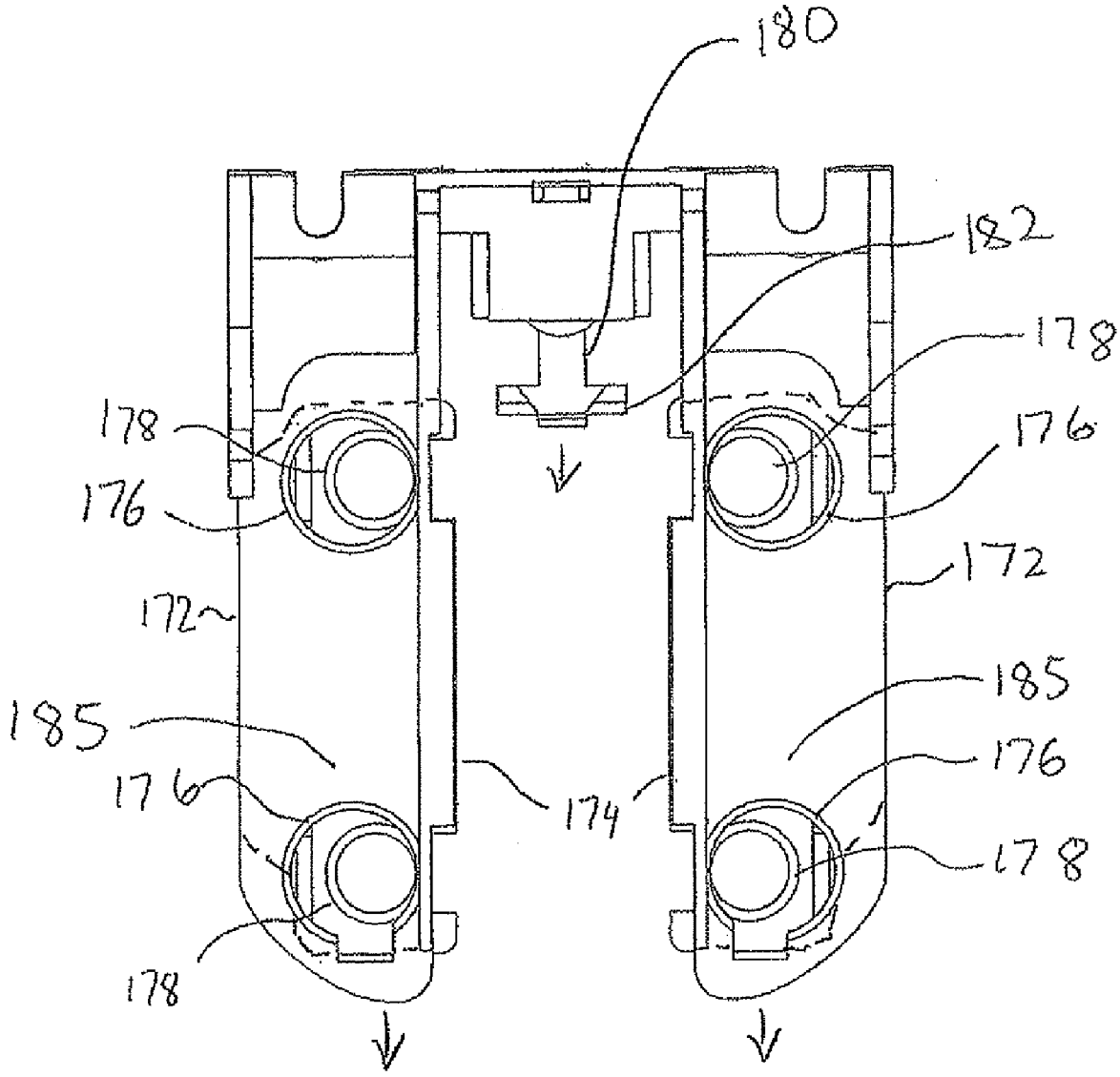
FIG. 1D is a schematic diagram that depicts in plan view exemplary wheel plates of the assembler of FIG. 1B, in a retracted position.

FIGS. 1C-1D depict details of assembling and launching features of launcher 160. FIG. 1C depicts a perspective view of wheel chambers 162 and their relationship to upper wheel plates 172 and lower wheel plates 174, in a retracted position. FIG. 1D depicts a top view of launcher 160 showing both upper and lower wheel plates. In the retracted position, the wheel apertures 176 of upper wheel plates 172, which are substantially concentric with chambers 162 are arranged with their central portions substantially directly above corresponding wheel apertures 178 of lower wheel plates. In this position, wheels placed in chambers 162 stack one on top of the other. The lowest set of wheels can fall through chambers 162 and apertures 176 to come to rest on lower wheel plates 172. The lower portions of the lowest set of wheels are configured to rest within apertures 178 after loading through chambers 162. In addition, launch member 180 is held behind retainer 182.

In the launch position (not shown), retainer 182 is pressed downwardly, releasing launch member 180 in the direction shown by the arrow, and the horizontal portion of lower wheel plates 174 is lowered, releasing wheels 126 of an assembled vehicle. Accordingly, an assembled vehicle 120 is thrust toward the front of launcher 160. In addition, in the launch position, upper wheel plates 172 are moved forwardly with respect to lower wheel plates 174, such that their central portions are displaced from the corresponding wheel apertures 178 of lower wheel plates. Accordingly, any wheels (not shown) positioned in wheel chambers 162 are prevented from falling by the solid horizontal portions 185 of upper wheel plates 172, which extend substantially under the bottom of chambers 162 in the launch position. Only when the launch pump 163 is released and the launcher returns to a retracted position can wheels fall into lower wheel plates 174.

Figure 8:
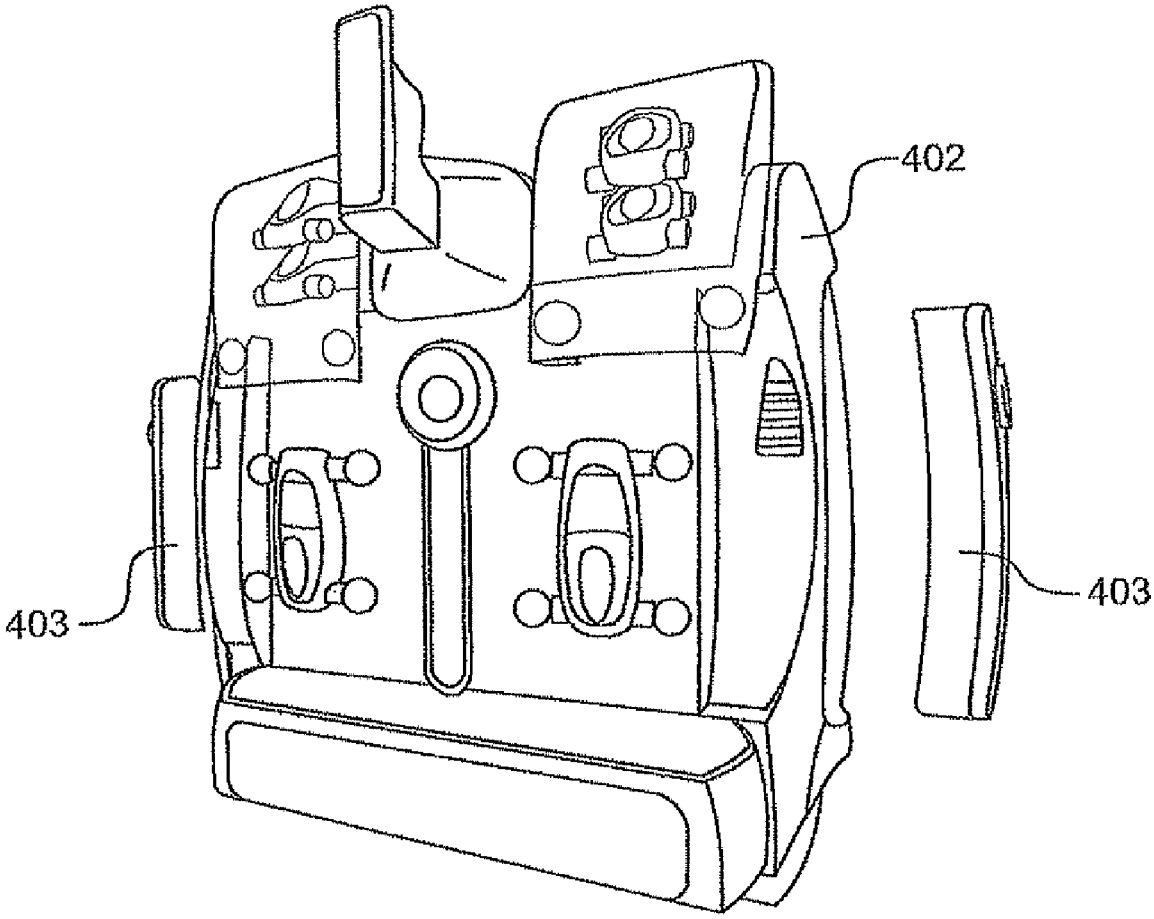
FIG. 8 is a schematic perspective view of a magnetic start portion of the vehicle track shown in FIG. 5, in accordance with an embodiment of the present invention.
Figure 9:
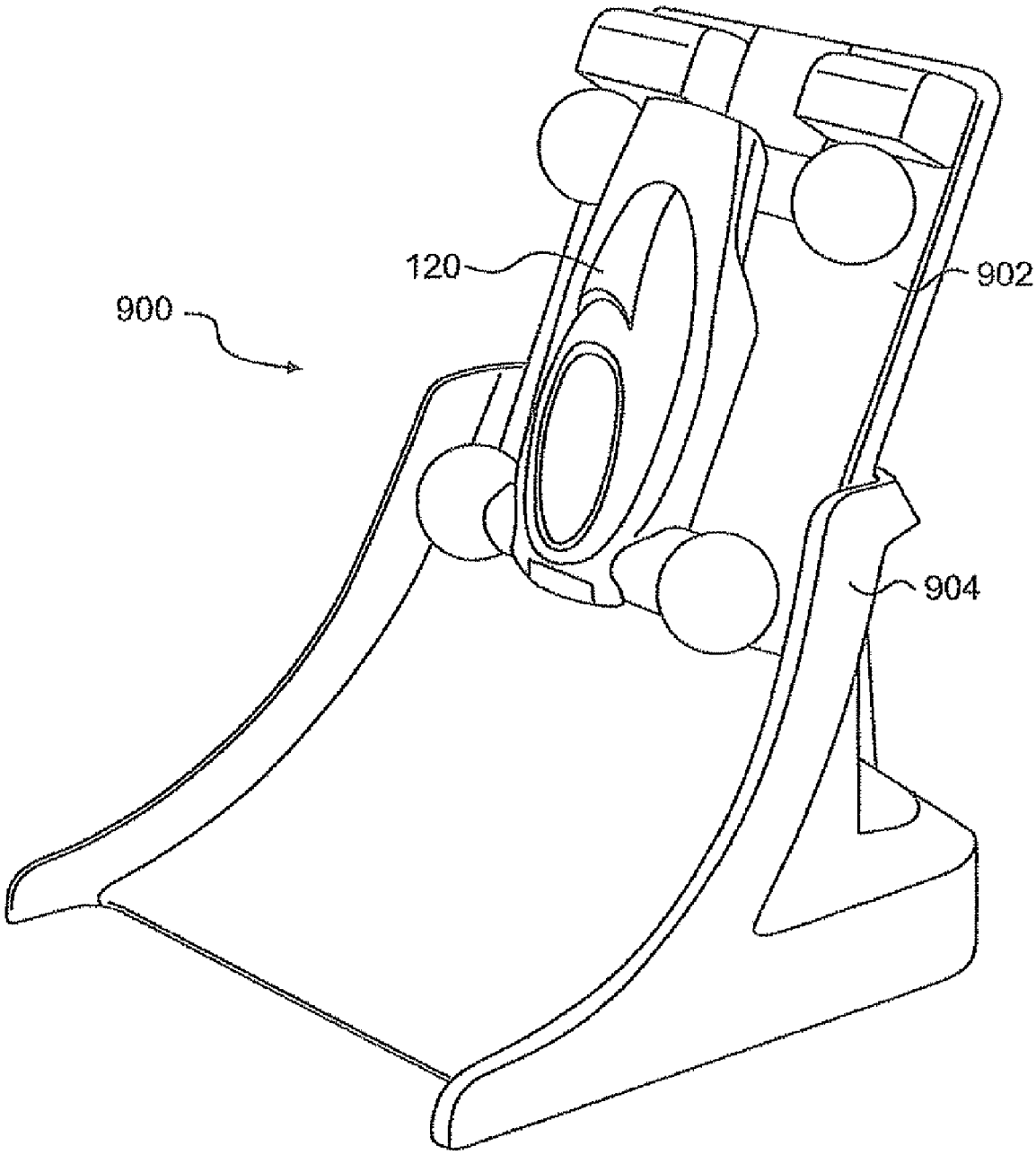
FIG. 9 is a schematic diagram that illustrates a magnetic vehicle launcher system arranged in accordance with another embodiment of the present invention.

FIG. 9 illustrates a magnetic vehicle launcher system 900 arranged in accordance with another embodiment of the present invention. As depicted, launcher 900 is a gravity launcher that comprises a holder portion 902 and short curved track portion, which is a simple exit ramp 904 in the embodiment depicted in FIG. 9. Holder portion 902 can be configured to reversibly detach from exit ramp 904. In accordance with an embodiment of the present invention, holder 902 is configured to magnetically hold a vehicle 120 at a substantial angle with respect to horizontal, for example, at an angle of about sixty to ninety degrees. When released, gravity causes vehicle 120 to rapidly descend and exit from curved ramp 904. In accordance with an embodiment of the present invention, exit ramp 904 can connect to a longer track portion, such as tracks described below with respect to FIGS. 4 and 8.

Figure 4:
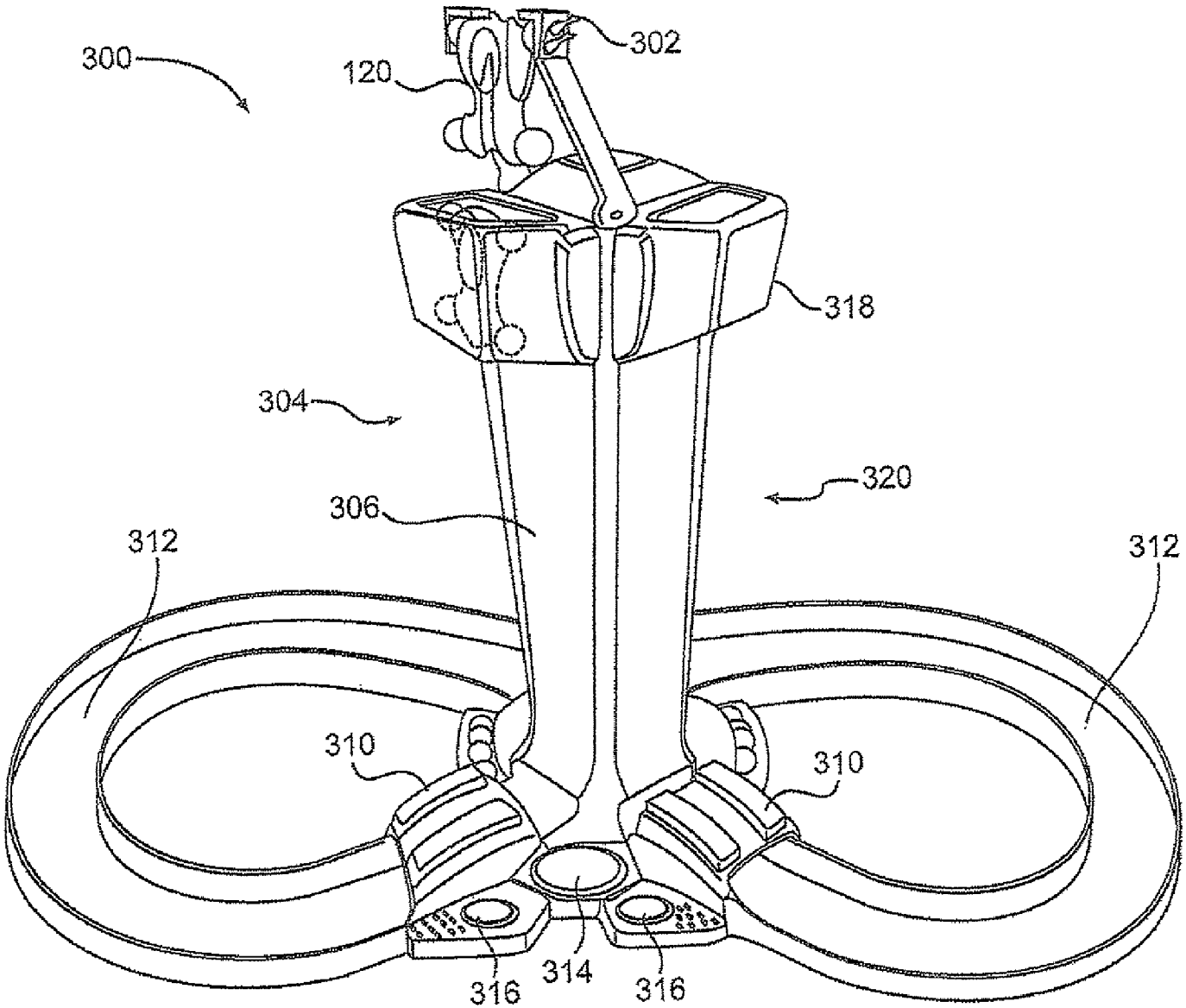
FIG. 4 is a schematic perspective view of a vehicle track, in accordance with an embodiment of the present invention.

In accordance with another aspect of the present invention, a vehicle track 300 as shown in FIG. 4 may be used in conjunction with a magnetic vehicle, such as vehicle 120 described herein. The track 300 may include a magnetic hanging starter 302, a vertical drop track 306, boosters 310, a figure-8 track 312, gates 318, and an elevator tower 320.

The track 300 can be used in the playing of a game, for example, wherein players attempt to capture or trap opponents vehicles 120 with gates 318. Alternatively, the gates 318 can be used by a player to gather his or her own vehicles.

The hanging starter 302 may be used as both a start and a finish. Vehicle 120 magnetically hangs by the hanger while waiting to be launched. The vehicle 120 may be launched when a player presses down on a remote, which can deactivate the magnet holding the vehicle 120. Depending on the play pattern, this game can be defensive or offensive. In both cases, a goal may be to gather vehicles 120 back to the hanging starter 302. In a defensive game, players would protect and gather their own cars. In the case of an offensive game, the goal would be to trap the opponent's cars.

Gates 318 may be activated by players to allow the vehicles to be attached to the hanging starter 302. If it is not timed correctly, the vehicle 120 will go back down the elevator 320 and back on the figure-8 track 312.

The elevator tower 320 magnetically carries the vehicle 120 upwards at 90 degrees. In this manner, the vehicle may be brought up to the hanging starter 302. If the player does not open their gates 318 at the right time, the vehicle 120 will be forced down the drop and back in the figure-8 track 312. The elevator tower 320 can be constructed similar to the magnetic lift track assembly described in pending U.S. Pub. No. 2007/0209543, application Ser. No. 11/648,577, filed Jan. 3, 2007, which is herein incorporated by reference in its entirety.

The figure-8 track 312 provides for a dynamic racing track and may be equipped with elevated banked curves. The boosters 310 propel the vehicle 120 to give it momentum and speed to race up the banked curves. A booster 310 can be, for example, a spinning wheel that contacts a surface of the vehicle and propels it forward. The boosters 310 may be activated by buttons 314 or 316, or any other activation device. The extra speed boosts add excitement to a competitive race between players. Players can keep track of their scores by manually adding spheres to their respective vaults (which is basically a depression that holds spheres). The track 300 can include a jump for added player enjoyment.

The track 300 enables at least two play patterns: an offensive play pattern and a defensive play pattern. In the offensives play pattern, the goal is to trap opponents' vehicles while, in the defensive play pattern, the goal is for a player to gather his or her own vehicles.

In accordance with one embodiment of the present invention, in one set of play patterns, cars 120 are released from the cartridges 318 (each player has a separate cartridge) by depressing a release button 316. Up to three cars can be stacked in each cartridge 318. Once the cars are released, they travel through tower 306 and are propelled on figure-8 shaped track 312 with the aid of electric spinning-wheel propellers (not shown) that could be contained in boosters 310. If the cars do not crash in the intersection of the track, each player can activate the tower's gate by pressing button 314. When opened, this gate instantly grabs a car and lifts the car to the top of tower 306. At the top of tower, a magnetic grabber lifts the car by the rear wheels and drops it randomly either in the player 1 cartridge, the player 2 cartridge, or on a "death drop" that eliminates the given car from the race and drops the car outside of track. In a play pattern 1, a player catches all his own cars in his own cartridge, while in a play pattern 2, a player catches all her opponent's cars in her cartridge.

Figure 5:
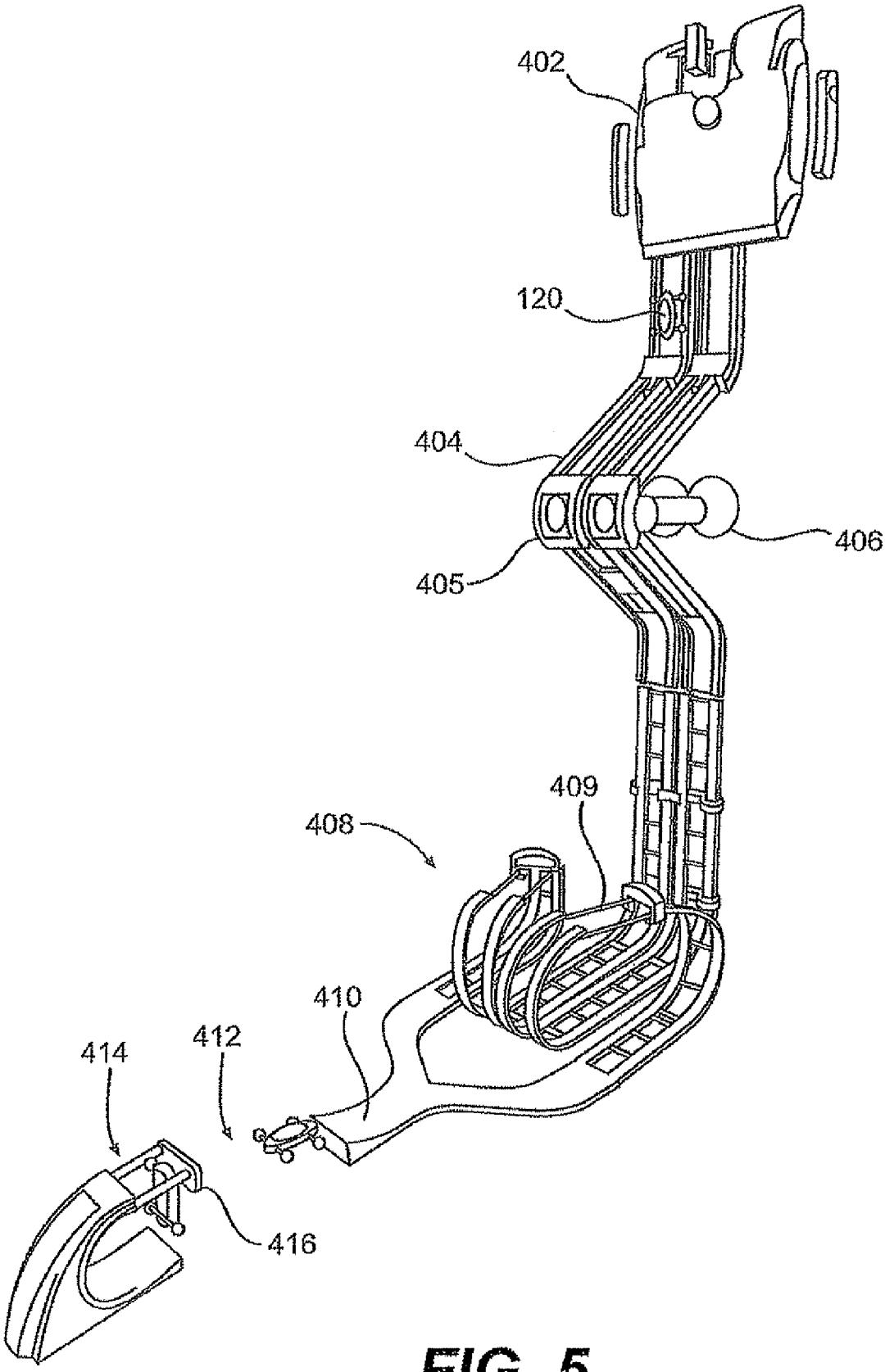
FIG. 5 is a schematic perspective view of a further vehicle track, in accordance with another embodiment of the present invention.

FIG. 5 shows a further track 400 that may be used in conjunction with magnetic vehicles such as the vehicles 120 described herein. The track 400 may be made of a ferromagnetic material or, alternatively, the track 400 may be made of plastic and contain a ferromagnetic metal embedded in or beneath the plastic. The track 400 may include a launcher 402, which may be remotely activated to release a magnetic vehicle 120. The track 400 may be secured to a vertical wall by, for example, a suction cup mechanism 406 or other suitable attachment device. The launcher 402 may also be attached to a wall by a suction cup mechanism or other suitable device.

In the portion 404 of the track 400 that accommodates the wall attachment device 406, the track may angle away from the wall and then back toward the wall. Covered portions 405 may be placed over that portion 404 of the track 400 in order to mechanically maintain a vehicle 120 within the magnetic attraction field of the track 400.

As depicted in FIG. 5, track 400 is a double track that can accommodate two vehicles racing side-by-side in adjacent tracks.

Figure 6:
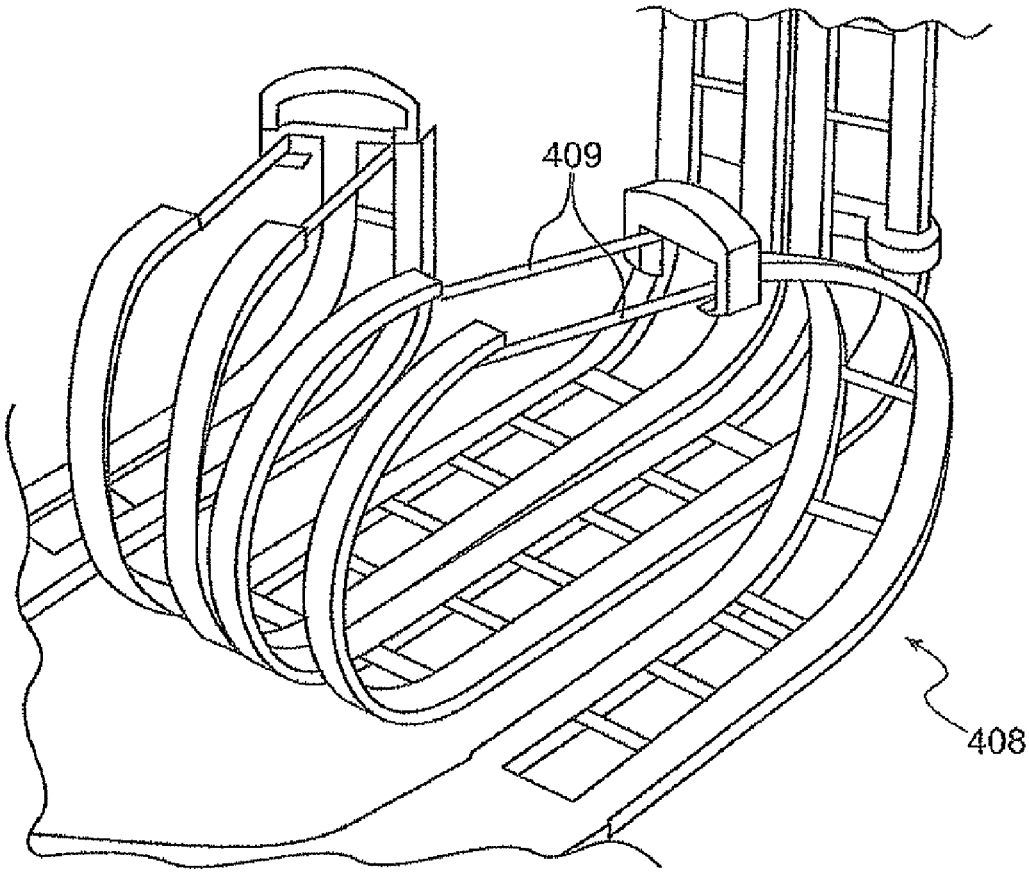
FIG. 6 is a schematic perspective view of a looped portion of the vehicle track shown in FIG. 5, in accordance with an embodiment of the present invention.

At a portion of the track 400 at which a vehicle has maintained a high speed, a loop portion 408 may be provided, as shown in greater detail in FIG. 6. The loop may include an exposed ferromagnetic portion 409 in order to increase the magnetic force while the vehicle 120 is upside down. Accordingly, referring again also to FIG. 1A, the magnetic wheels 126 of an upside down vehicle traversing the loop portion having exposed magnetic tracks 409 have a stronger magnetic attraction to the exposed magnetic tracks when the magnetic wheels are adjacent to the exposed magnetic tracks 409 as opposed to the magnetic attraction of the magnetic wheels 126 to portions of the tracks that are covered by a non-magnetic material when the magnetic wheels 126 are adjacent to the covered track portions. This helps overcome the gravitational force acting upon the vehicle that would tend to dislodge the vehicle 120 from track 400 when upside down.

Figure 7:
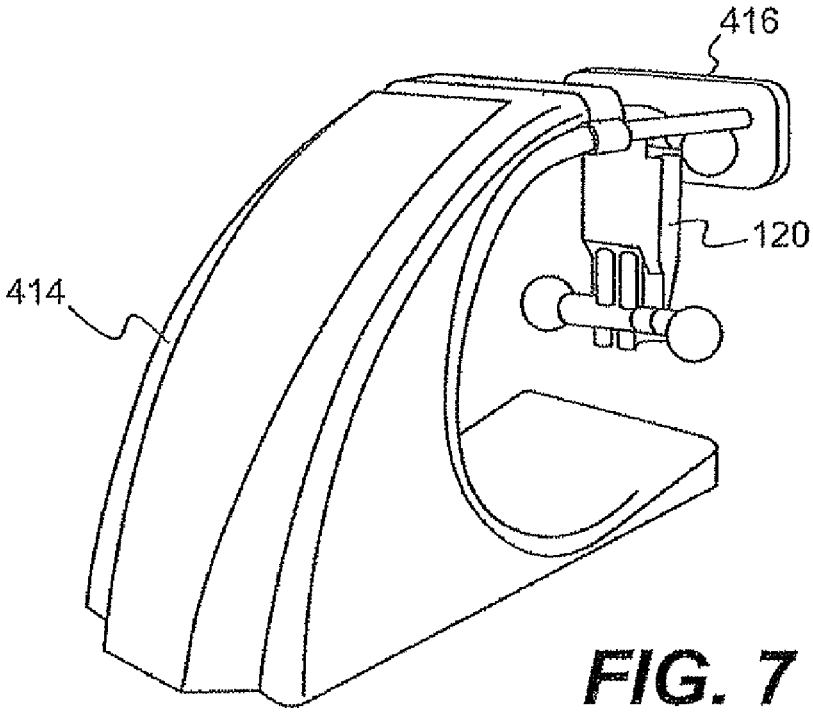
FIG. 7 is a schematic perspective view of a finish hanger portion of the vehicle track shown in FIG. 5, in accordance with an embodiment of the present invention.

FIG. 7 shows a detail view of a finish hanger portion 414. The finish hanger portion 414 may be configured as a loop, as shown in FIG. 7, and may include a magnetic hanger 416 at the end of the loop to catch a vehicle after the vehicle makes the jump 412 from the merged portion 410 of the track 400. In one example, the vehicle speed at the merged portion is such that the vehicle lands on the hanger 414 at the bottom of the loop portion, continues around the loop, arriving upside down to encounter magnetic hanger 416, which stops the vehicle and holds the vehicle by a set of two wheels as shown. In another example, the magnetic hanger 416 could be positioned to catch a vehicle in the air after exiting the merged portion 410.

The starting launcher 402 may by similar to the launchers previously described herein, in which the vehicle 120 may be self-assembled after inserting the vehicle body and the ferromagnetic sphere wheels separately. In one embodiment of the present invention depicted in FIG. 8, the starting launcher 402 is a gravity fed launcher. The launcher may hold a magnetic vehicle magnetically, or by other means. As also described above, the launcher may be activated by a switch on the launcher 402 or by remote control, such as hand held remote control devices 403, to release the vehicles 120.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure.

For example, in the present invention, embodiments are contemplated in which the vehicle hubs comprise soft magnetic materials, and the wheels comprise permanent magnets. In addition, the present invention includes embodiments in which the permanent magnets, including any magnets located in the hubs or the spherical wheels, are made from ferrimagnetic materials, which are well known materials that can be used as magnets.

Additionally, as noted previously, the present invention includes embodiments in which magnetic hubs are fixed within a vehicle, such that the hubs do not rotate. In these embodiments, during vehicle motion, the wheels undergo rotation with respect to the fixed hubs. For example, in the case of spherical wheels against a magnetic hub having a flat magnetic face, the point contact between the spherical wheel and the flat face can enable the spherical wheel to rotate freely.

Furthermore, embodiments of the present invention are contemplated in which the assembled toy is a humanoid, robotic, or animal form. For example, the central toy portion could be an animal body, and four outer spheres or cylinders could represent the limbs of the animal.

Furthermore, embodiments of the present invention are contemplated in which a toy vehicle or other toy comprises three or more axles.

Furthermore, iii accordance with other embodiments of the present invention, the components of track systems described above can be used in any combination with a magnetic vehicle. For example, the magnetic hanger system depicted in FIG. 7 could be used to terminate a track portion that can be non-magnetic, such as the tracks depicted in FIG. 4.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible.

What is claimed is:

1. A toy assembly system, comprising:

a central compartment configured to house one or more toy bodies, each toy body having a plurality of magnetic hubs each arranged in an outer region of the toy body;

a set of outer compartments each separated from the central compartment and configured to house one or more ferromagnetic outer components separate from the one or more toy bodies such that the ferromagnetic outer components are separated from the magnetic hubs;

an assembly chamber, wherein each of the separate central compartment and outer compartments leads to the assembly chamber;

a toy body disposed inside the central compartment before release, the toy body having a plurality of magnetic hubs each arranged in an outer region of the toy body;

a set of ferromagnetic outer components, each ferromagnetic outer component of the set of ferromagnetic outer compartments disposed inside a different outer compartment before release; and a release mechanism configured to release the toy body and the set of ferromagnetic outer components into an assembly position in the assembly chamber, wherein in the assembly chamber the toy body and the set of ferromagnetic outer components are arranged to self-assemble by virtue of magnetic attraction between the magnetic hubs and the ferromagnetic outer components such that the set of outer components attaches to the toy body.

2. The toy assembly system of claim 1, wherein the set of outer components comprises one of a set of spheres and a set of cylinders.

3. The toy assembly system of claim 1, wherein the toy body comprises a vehicle body, and wherein the set of outer compartments comprises a set of chambers configured to house wheels for each wheel position of the vehicle body.

4. The toy assembly system of claim 3, wherein the wheels are ferromagnetic spheres, wherein the magnetic hubs of the toy body comprise rotatable cylindrical bodies that each include a magnet and each include a cylinder top that is configured to attach to a ferromagnetic sphere, and wherein the rotatable cylindrical bodies are each disposed on a rotatable shaft whose longitudinal axis is perpendicular to a direction of travel of the toy body.

5. The toy assembly system of claim 4, wherein the cylinder top includes a circular recess configured to accommodate a portion of a ferromagnetic sphere.

6. The toy assembly system of claim 1, wherein the release mechanism comprises:

a first retractable holder that releases the set of outer components into the assembly position;

a second retractable holder that releases the toy body into the assembly position, wherein when the toy body and the set of outer components are in the assembly position, no barrier exists between the toy body and the set of outer components; and a lever that actuates the first retractable holder and the second retractable holder.

7. The toy assembly system of claim 1, further comprising an ejector configured to propel an assembled toy in a forward motion from the toy assembly system, wherein the ejector includes a set of retractable barriers configured to permit the forward motion of the assembled toy when in an ejection position.

8. The toy assembly system of claim 1, wherein the central compartment and outer compartments are contained in a common housing, and wherein at least portions of the central and outer compartments are transparent, such that, at a given time, at least one toy body and a set of outer components are substantially visible to an operator of the toy assembly system.

9. The toy assembly system of claim 1, further comprising an ejector configured to propel an assembled toy body and set of ferromagnetic outer components from the assembly chamber.

10. The toy assembly system of claim 9, further comprising a release lever that is mechanically coupled to the ejector, wherein, when moved in a first direction, the release lever is configured to release a toy body and a set of ferromagnetic outer components into the assembly chamber, wherein the toy body and the set of ferromagnetic outer components form an assembled toy, and wherein, when moved in a second direction, different from the first direction, the release lever is configured to eject the assembled toy.

11. The toy assembly system of claim 1, wherein each toy body has a plurality of axles mutually parallel to one another, wherein each axle extends along a longitudinal axis from a first axle end to a second axle end, wherein each axle is configured with a magnetic hub at both ends, each magnetic hub having a rotational axis aligned with the longitudinal axis of its respective axle, and wherein the set of ferromagnetic outer components comprises a plurality of ferromagnetic spheres, wherein each ferromagnetic sphere is reversibly attachable to a magnetic hub, wherein the rotational axis of the magnetic hub is aligned with a center of the ferromagnetic sphere.

12. The toy assembly system of claim 11, wherein the plurality of magnetic hubs each comprises a permanent cylindrical magnet having a cylinder axis aligned with the longitudinal axis of its respective axle, wherein the ferromagnetic spheres comprise a soft magnetic material, and wherein the diameter of the ferromagnetic spheres is larger than the diameter of the cylindrical magnets.

13. The toy assembly system of claim 12, further comprising a recess provided on a cylinder top of each magnetic hub, the recess configured to seat a ferromagnetic sphere.

14. The toy assembly system of claim 11, wherein the ferromagnetic spheres comprise permanent magnets.

15. The toy assembly system of claim 14, wherein the magnetic hubs comprise a soft magnetic material.

16. The toy assembly system of claim 1, wherein the central compartment is configured to house the one or more toy bodies in a stacked configuration, wherein the one or more toy bodies are arranged one on top of another a launching system configured to propel an assembled toy vehicle from the assembly position.

17. The toy assembly and launch system of claim 16, wherein each magnetic hub of a plurality of magnetic hubs of a toy body is arranged with a magnetic polarization that is the same as every other magnetic hub of the plurality of magnetic hubs, and wherein a configuration of magnetic polarization of the magnetic hubs of each toy body is the same such that toy bodies stacked in the same orientation within the central compartment repel each other.

18. The toy assembly system of claim 1, wherein the toy body attaches to the set of ferromagnetic outer components to form an assembled toy vehicle, wherein the toy assembly system further comprises a launching system configured to propel the assembled toy vehicle from the assembly position, wherein the launching system comprises:

a ramp arranged at the assembly position and configured to act with gravity to propel an assembled toy vehicle from the assembly position;

an ejector configured to perform one of striking, pushing, and flinging an assembled vehicle; and a movable barrier configured to block vehicle movement in a first position, which barrier, when moved to a second position, allows an assembled toy vehicle to move forward when subject to action of gravity or the ejector.

19. The toy assembly system of claim 18, further comprising a release lever that is mechanically coupled to the ejector, wherein, when moved in a first direction, the release lever is configured to release the toy body and the set of ferromagnetic outer components into the assembly position, wherein the toy body and the set of ferromagnetic outer components form the assembled toy vehicle, and wherein, when moved in a second direction, different from the first direction, the release lever is configured to eject the assembled toy vehicle.

20. The toy assembly system of claim 1, wherein the toy body attaches to the set of ferromagnetic outer components to form a magnetic vehicle, and wherein the toy assembly system further comprises a toy track system for use in conjunction with the magnetic vehicle, the toy track system comprising:

a launch portion configured to magnetically retain the magnetic vehicle in a launch position;

a release configured to release the magnetic vehicle from the launch position, wherein the released magnetic vehicle is free to move under the force of gravity; and a track portion coupled to the launch portion and configured to guide the released magnetic vehicle along a predetermined path, wherein the launch portion magnetically retains the magnetic vehicle by magnetically holding one or more of the ferromagnetic outer components.

21. The toy assembly system of claim 20, wherein the launch portion of the toy track system comprises a remote release.

22. The toy assembly system of claim 20, wherein the launch portion of the toy track system comprises a magnetic hanger, and wherein the toy track system further comprises:

a tower connected on an upper end to the launch portion and on a lower end to the track portion; and a magnetic elevator configured to transfer the magnetic vehicle from the track portion to the launch portion.

23. The toy assembly system of claim 20, wherein the track portion of the toy track system comprises:

a covered track portion that includes a magnetic inner portion and a non-magnetic outer portion; and an uncovered track portion that comprises a magnetic material and is configured to exert a magnetic attractive force on the magnetic vehicle that is stronger than a magnetic attractive force exerted by the covered track portion when the magnetic vehicle is adjacent to the respective uncovered and covered track portions.

24. The toy assembly system of claim 20, wherein the toy track system further comprises a magnetic hanger portion that comprises:

a loop portion; and a magnetic hanger connected to a first end of the loop portion and configured to catch and retain the magnetic vehicle in a substantially vertical position when the magnetic vehicle reaches the first end of the loop portion.

* * * * *